US011359877B2

(12) United States Patent
Van Donkelaar

(10) Patent No.: US 11,359,877 B2
(45) Date of Patent: Jun. 14, 2022

(54) APPARATUS AND METHOD FOR ACCELERATING AN OBJECT VIA AN EXTERNAL FREE JET

(71) Applicant: Wave Motion Launch Corporation, Everett, WA (US)

(72) Inventor: Finn Van Donkelaar, Seattle, WA (US)

(73) Assignee: Wave Motion Launch Corporation, Everett, WA (US)

( * ) Notice: Subject to any disclaimer, the term of this patent is extended or adjusted under 35 U.S.C. 154(b) by 0 days.

(21) Appl. No.: 17/142,959

(22) Filed: Jan. 6, 2021

(65) Prior Publication Data

US 2021/0148661 A1 May 20, 2021

Related U.S. Application Data

(62) Division of application No. 16/661,337, filed on Oct. 23, 2019, now Pat. No. 10,928,146.

(60) Provisional application No. 62/830,040, filed on Apr. 5, 2019, provisional application No. 62/749,984, filed on Oct. 24, 2018.

(51) Int. Cl.
*F41A 1/04* (2006.01)

(52) U.S. Cl.
CPC ..... *F41A 1/04* (2013.01)

(58) Field of Classification Search
CPC .. F41A 1/04; F42B 11/60; F42B 11/70; F42B 11/80; F42B 14/064
USPC ..... 89/7
See application file for complete search history.

(56) References Cited

U.S. PATENT DOCUMENTS

| | | | |
|---|---|---|---|
| 392,922 | A | 11/1888 | Johnson et al. |
| 1,999,357 | A | 4/1935 | Driggs |
| 4,344,592 | A | 8/1982 | Constantinescu |
| 4,711,414 | A | 12/1987 | Dunn |
| 4,722,261 | A | 2/1988 | Titus |
| 4,932,306 | A | 6/1990 | Rom |
| 4,938,112 | A | 7/1990 | Hertzberg et al. |

(Continued)

OTHER PUBLICATIONS

Latvala, E. K. et al., "Studies of the Spreading of Rocket Exhaust Jets at High Altitudes," Planetary and Space Science, vol. 4, No. 1, 1961, pp. 77-91. doi: 10.1016/0032-0633(61)90124-6.

(Continued)

*Primary Examiner* — Bret Hayes
(74) *Attorney, Agent, or Firm* — Cooley LLP

(57) ABSTRACT

An apparatus includes an energy source and an expansion structure. The energy source is configured to convey an amount of energy operable to increase a pressure of a compressible gas disposed in a chamber. The expansion structure is configured to be placed in fluid communication with the chamber and to receive a flow of the compressible gas in response to the increase in pressure. The expansion structure includes an inlet having a first diameter and an outlet having a second diameter greater than the first diameter and is configured to allow the compressible gas to expand as the compressible gas flows from the inlet to the outlet such that a supersonic free jet of the compressible gas exits the outlet. In some instances, the supersonic free jet of the compressible gas can accelerate, relative to the expansion structure, a projectile disposed outside of the expansion structure.

8 Claims, 14 Drawing Sheets

(56) References Cited

U.S. PATENT DOCUMENTS

| | | | | |
|---|---|---|---|---|
| 5,012,719 | A | 5/1991 | Goldstein et al. | |
| 5,033,355 | A | 7/1991 | Goldstein et al. | |
| 5,097,743 | A * | 3/1992 | Hertzberg | F41A 1/02 60/767 |
| 5,194,690 | A | 3/1993 | Guthrie et al. | |
| 5,303,633 | A | 4/1994 | Guthrie et al. | |
| 5,394,805 | A | 3/1995 | Giraud et al. | |
| 5,992,291 | A | 11/1999 | Widder et al. | |
| 6,488,233 | B1 | 12/2002 | Myrabo | |
| 7,305,912 | B2 | 12/2007 | Goldstein et al. | |
| 8,226,046 | B2 | 7/2012 | Poulos | |
| 10,928,146 | B2 * | 2/2021 | Van Donkelaar | F41B 11/60 |
| 2013/0287504 | A1 | 10/2013 | Gatley | |
| 2014/0306065 | A1 | 10/2014 | Palmer et al. | |
| 2015/0253101 | A1 | 9/2015 | Scarr | |
| 2016/0363403 | A1 | 12/2016 | Kopecky | |
| 2020/0025511 | A1 | 1/2020 | Cherry et al. | |

OTHER PUBLICATIONS

Orescanin, M. M. et al., "Exhaust of Underexpanded Jets from Finite Reservoirs," Journal of Propulsion and Power, vol. 26, No. 4, Jul.-Aug. 2010, pp. 744-753.

Driftmyer, R. T. "A Correlation of Freejet Data," AIAA Journal, vol. 10, No. 8 (1972), pp. 1093-1095. doi: 10.2514/3.50306.

Rutberg, Ph. G. et.al., "Experimental Study of Hydrogen Heating in Powerful Electric Discharge Launcher," Journal of Propulsion and Power, vol. 13, No. 5, 1997, pp. 659-664.

Summerfield, M. "Development of A Linear Piston-Type Pulse Power Electric Generator for Powering Electric Guns," IEEE Transactions on Magnetics, vol. 29, No. 1, 1993, pp. 1066-1069.

Zapryagaev, V. I. et al., "Shock-Wave Structure of Supersonic Jet Flows," Aerospace, 2018, vol. 5, No. 2.-N paper 60, pp. 1-18: doi:10.3390/aerospace5020060.

* cited by examiner

APPARATUS AND METHOD FOR ACCELERATING AN OBJECT VIA AN EXTERNAL FREE JET

CROSS-REFERENCE TO RELATED APPLICATIONS

This application is a divisional of U.S. patent application Ser. No. 16/661,337, entitled "Apparatus and Method for Accelerating an Object Via an External Free Jet," filed Oct. 23, 2019, which claims priority to and the benefit of U.S. Provisional Patent Application Ser. No. 62/830,040, entitled "Apparatus and Method for Accelerating an Object Via an External Free Jet," filed Apr. 5, 2019 and U.S. Provisional Patent Application Ser. No. 62/749,984, entitled "Apparatus and Method for Projectile Acceleration With an External Free Jet," filed Oct. 24, 2018, the disclosure of each of which is incorporated herein by reference in its entirety.

TECHNICAL FIELD

Embodiments described herein relate generally to apparatus and methods capable of imparting acceleration to objects, and more particularly, to apparatus and methods for accelerating a projectile using an external free jet.

BACKGROUND

Numerous systems and methods for launching and/or accelerating objects (e.g., projectiles) are known. For example, some known "gun-type" launchers function by allowing a pressurized working fluid to expand, or an electromagnetic field to pass, along a support structure to accelerate a projectile disposed within that structure. In order to achieve high projectile velocities, such support structures can become very long and/or mechanically complex, which can make these types of launchers impractical for some use cases. In some instances, heat transfer to the support structure and an amount of time it takes to traverse the support structure can place limitations on a firing rate of these launchers. Moreover, a size of the projectile used in such launchers is limited to or by an inner width of the support structure.

Some other known systems and methods of accelerating projectiles use a rocket propelled vehicle. While such systems and methods may be capable of imparting a desired final velocity to a projectile, the rocket engines and associated structure generally travel with the projectile during acceleration, which in turn, can limit such systems and methods to relatively low accelerations and can be difficult to reuse at high projectile velocities. Other known systems and methods of accelerating projectiles use coherent radiation to heat the air surrounding the projectile or stagnated supersonic jets accelerated through a support structure. Some such systems and methods, however, can suffer from high capital costs, especially at large scales.

Accordingly, a need exists for improved systems and methods for accelerating objects and/or projectiles.

SUMMARY

Apparatus, systems, and/or methods for accelerating objects using a supersonic free jet are described herein. In some embodiments, an apparatus includes an energy source and an expansion structure. The energy source is configured to convey an amount of energy to a volume of a compressible gas disposed in a chamber. The energy conveyed to the volume of the compressible gas is operable to increase a pressure associated with the volume of the compressible gas. The expansion structure is configured to be placed in fluid communication with the chamber to receive a flow of the compressible gas in response to the increase in pressure. The expansion structure includes an inlet having a first diameter and an outlet having a second diameter greater than the first diameter and is configured to allow the compressible gas to expand as the compressible gas flows from the inlet to the outlet such that a supersonic free jet of the compressible gas exits the outlet. In some instances, the supersonic free jet of the compressible gas can accelerate a projectile disposed outside of the expansion structure.

DETAILED DESCRIPTION

Figure 1:
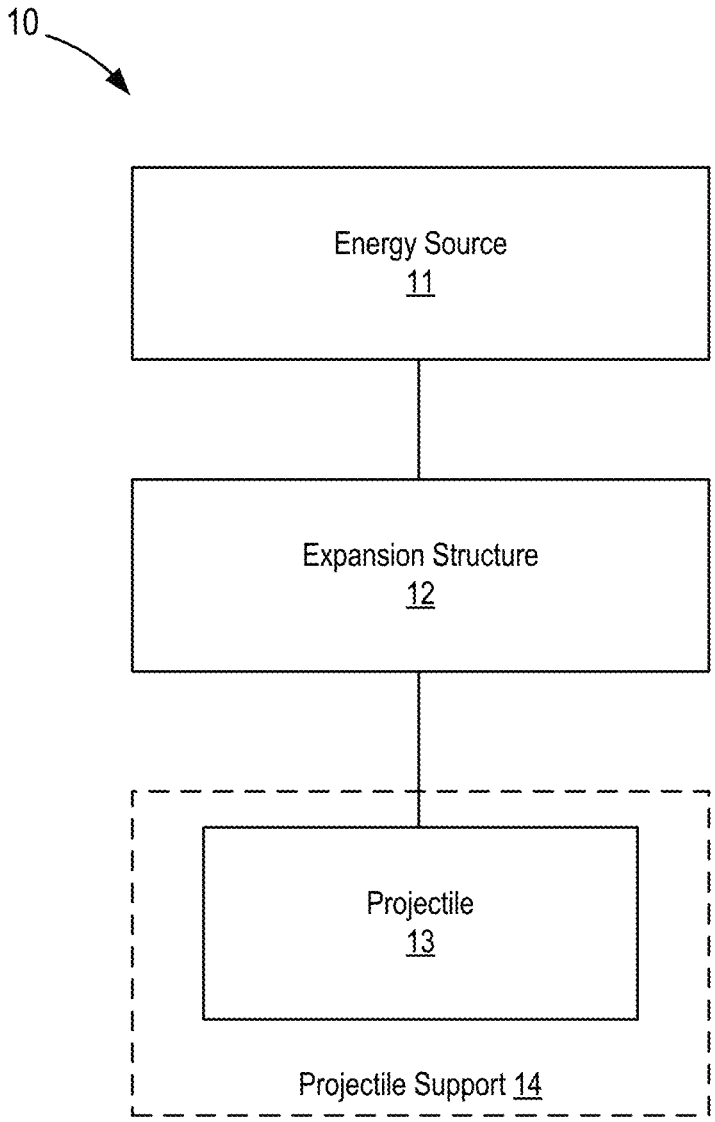
FIG. 1 is a schematic block diagram of a projectile launcher according to an embodiment.

In some embodiments, an apparatus includes an energy source and an expansion structure. The energy source is configured to convey an amount of energy to a volume of a compressible gas disposed in a chamber. The energy conveyed to the volume of the compressible gas is operable to increase a pressure associated with the volume of the compressible gas. The expansion structure is configured to be placed in fluid communication with the chamber to receive a flow of the compressible gas in response to the increase in pressure. The expansion structure includes an inlet having a first diameter and an outlet having a second diameter greater than the first diameter and is configured to allow the compressible gas to expand as the compressible gas flows from the inlet to the outlet such that a supersonic free jet of the compressible gas exits the outlet. In some instances, the supersonic free jet of the compressible gas can accelerate a projectile disposed outside of the expansion structure.

In some embodiments, a projectile launcher can include a chamber, a rocket engine nozzle in communication with an opening of the chamber, and a projectile disposed adjacent to an exit plane of the rocket engine nozzle (e.g., outside of the nozzle). The chamber is configured to receive a propellant and to at least temporarily retain the propellant in the chamber. The projectile launcher includes a means for imparting thermal energy to the propellant contained in the chamber. The thermal energy is operable to increase a pressure of the propellant in a predetermined manner such that pressurized propellant is communicated through the opening of the chamber and through the rocket engine nozzle in a predetermined manner.

In some embodiments, a method includes disposing a projectile in a desired position adjacent to and outside of an outlet of a nozzle. A pressure of a compressible gas disposed in a chamber is increased. Fluid communication is established between the chamber and an inlet of the nozzle when a pressure of the compressible gas exceeds a threshold pressure. At least a portion of the compressible gas is expanded as the compressible gas flows from the inlet to the outlet of the nozzle such that a supersonic free jet exits the outlet of the nozzle. The projectile is accelerated relative to the outlet of the nozzle in response to the supersonic free jet stagnating against a surface of the projectile.

In some embodiments, a method includes disposing a projectile in a desired position adjacent to and outside of an outlet of a nozzle. A pressure of a volume of a compressible gas disposed in a chamber is increased. The chamber is configured to be in fluid communication with an inlet of the nozzle. Incompressible particles are introduced into the volume of the compressible gas and the volume of the compressible gas is expanded as the compressible gas flows from the inlet of the nozzle to the outlet of the nozzle. A first free jet having a first velocity and a first Mach number is produced from the outlet of the nozzle as a result of the expanding. A second free jet is produced from the outlet of the nozzle as a result of the expanding. The second free jet has a second velocity lower than the first velocity and a second Mach number greater than the first Mach number and is a substantially annular free jet that circumferentially surrounds the first free jet. The method further includes accelerating the projectile relative to the outlet of the nozzle in response to a thrust associated with first free jet stagnating against a base surface of the projectile.

In some embodiments, a method of accelerating a projectile can include introducing the projectile to the exit plane of a rocket engine nozzle. A chamber in communication with the nozzle is filled with a propellant. Thermal energy is added to the propellant to effect emission of heated propellant through the nozzle, thereby resulting in a supersonic free jet. The method further includes stagnating the supersonic free jet against a base of the projectile (e.g., to accelerate the projectile), wherein the projectile is stabilized during acceleration by aerodynamic interactions with the supersonic free jet.

In some embodiments, the apparatus, systems, and/or methods described herein can be configured to continuously accelerate a projectile using a supersonic and/or hypersonic free jet without the use of a supporting structure (e.g., a barrel or the like) surrounding the acceleration path of the jet. Said another way, the apparatus, systems, and/or methods described herein can be configured to accelerate a projectile that is disposed at or adjacent to an exit plane of a nozzle and thus, the projectile is not accelerated through a supporting structure such as a barrel or the like. In some embodiments, such an arrangement, for example, can result in a device and/or system that is shorter (e.g., an order of magnitude shorter) than at least some known gun-type projectile launchers. The lack of a supporting structure such as a barrel can also reduce and/or substantially eliminate limitations on a size of the projectile otherwise resulting from the use of a barrel or similar structure. Moreover, the embodiments described herein can be configured to transfer waste heat generated during an acceleration process to the surrounding atmosphere and/or to recover at least a portion of the heat rather than transferring the heat to a supporting structure (e.g., barrel or the like). As such, the embodiments and/or methods described herein can result in and/or can otherwise use a relationship between pressure and velocity in a flow of a supersonic and/or hypersonic compressible fluid to accelerate any suitable object or projectile with a free jet that is not enclosed, directed, confined, restricted, and/or otherwise limited by a barrel, as described in further detail herein.

As used in this specification, the singular forms "a," "an," and "the" include plural referents unless the context clearly dictates otherwise. Thus, for example, the term "a member" is intended to mean a single member or a combination of members, "a material" is intended to mean one or more materials, or a combination thereof.

As used herein, the terms "rocket engine nozzle" and/or "nozzle" can refer to any suitable nozzle that expands and accelerates (or allows for the expansion and acceleration of) a pressurized working fluid to supersonic velocities. A non-limiting list of such a "rocket engine nozzle" and/or "nozzle" can include, for example, a de Laval nozzle (e.g., a convergent-divergent nozzle), a divergent nozzle, a dual expansion nozzle, a dual throat nozzle, a plug nozzle, a bell nozzle, an aerospike, and/or any other suitable nozzle geometries. As used herein, the term "expansion structure" can be used to refer to any suitable nozzle (such as those described above) and/or any other suitable structure that may or may not be considered a nozzle that is configured to allow for expansion and acceleration of a pressurized working fluid to supersonic velocities.

As used herein, "propellant" can refer generally to any suitable compound or elemental substance which combines, decomposes, and/or is supplied with energy from an external source to produce a gas at an elevated pressure (and often elevated temperature). In some embodiments, a propellant can be a combustible solid propellant, a combustible liquid propellant, and/or a non-combustible propellant. As used herein, the term "working fluid" can be used to refer to a fluid (e.g., liquid) that is accelerated through any of the devices described herein to generate, for example, a supersonic free jet. In some instances, the term "working fluid"

can refer to a propellant or to gaseous products resulting from combustion of a propellant.

As used herein, "electrothermal" can refer to an electrical energy source (or the use of an electrical energy source) configured to impart thermal energy to a propellant via any suitable transfer mode. By way of example, in some embodiments, an electrothermal energy source can be an electrical energy source configured to provide a spark or arc to a volume of a compressed gas (e.g., propellant).

As used herein, "ballistic efficiency" can refer to a ratio of an amount of kinetic energy of a projectile directly after acceleration has been imparted to the projectile divided by an amount of thermal energy imparted to the propellant.

The embodiments and methods described herein are configured to produce a free jet that flows, for example, through the atmosphere outside of a supporting structure (e.g., a barrel). As known in the art, when an object moves through the atmosphere with sufficient speed, a portion of the energy that otherwise moves the object instead compresses a portion of the air ahead of and/or around the object. When the object moves through the atmosphere at or near the speed of sound (e.g., at "transonic" speeds), the compressive effects result in disturbances in the flow of the atmosphere (air) around the object, which can increase as the speed of the object increases relative to the speed of sound. Moreover, sufficient disturbances in the flow of the atmosphere (air) around the object can result in a shock wave structure.

The embodiments and/or methods described herein are configured to produce a free jet that flows through the atmosphere at speeds greater than the speed of sound. As used herein, the terms "supersonic" and "hypersonic" generally refer to a range of speeds of an object (e.g., a flow of a working fluid, a projectile, and/or the like) relative to the speed of sound for a given atmospheric condition. More specifically, the term "supersonic" generally refers to a range of speeds slightly about the speed of sound up to about five times the speed of sound and the term "hypersonic" generally refers to a range of speeds greater than about five times the speed of sound. The ratio of the speed of an object relative to the speed of sound is commonly referred to as a "Mach Number" or simply "Mach". Accordingly, supersonic speeds are generally in a range slightly above Mach 1.0 to about Mach 5.0, while hypersonic speeds are generally in a range greater than Mach 5.0.

FIG. 1 is a schematic illustration of a projectile launcher 10 according to an embodiment. The projectile launcher 10 (also referred to herein as "launcher") can be any suitable shape, size, and/or configuration. In addition, the launcher 10 can be configured to accelerate any suitable mass load, object, projectile, etc. As described in further detail herein, the launcher 10 can generate a supersonic fluid flow (e.g., a high temperature flow of gas at speeds greater than the speed of sound at a given altitude) outside of a support structure such as a barrel or the like, which in turn, can be stagnated against an object to accelerate the object.

As shown in FIG. 1, the launcher 10 includes an energy source 11 and an expansion structure 12, and is configured to accelerate a projectile 13. More specifically, the launcher 10 can include any suitable chamber, vessel, and/or structure configured to receive and/or at least temporarily contain a working fluid, which can receive an amount of energy from the energy source 11 operable to generate a high pressure flow of the working fluid through the expansion structure 12. The expansion structure 12 can, in turn, allow the working fluid to expand as the working fluid flows therethrough and can expel a supersonic or hypersonic free jet of the working fluid from an outlet of the expansion structure 12 that can be used to accelerate the projectile 13. In addition, in some embodiments, the launcher 10 can include and/or can be used with an optional projectile support 14 configured to support the projectile 13 in a desired position relative to the outlet of the expansion structure 12 prior to the expansion structure 12 expelling the supersonic or hypersonic free jet. In this context, a "free jet" refers to a jet that is not bounded by a structure such as a barrel or the like.

Although not shown in FIG. 1, the launcher 10 can include one or more of a housing, chamber, vessel, and/or any other suitable structure configured to enclose or contain any suitable portion of the launcher 10. For example, in some embodiments, the launcher 10 can include a housing, shroud, and/or structure configured to house or enclose at least a portion of the energy source 11 and/or the expansion structure 12. In other embodiments, the launcher 10 need not include such a housing, shroud, and/or structure.

The energy source 11 of the launcher 10 can be any suitable feature, structure, device, mechanism, etc. configured to convey an amount of energy to a working fluid contained in a portion of the launcher 10. For example, in some instances, the energy source 11 can convey energy to the working fluid that is operable to increase a temperature, pressure, internal energy, and/or enthalpy of the working fluid. In other instances, the energy source 11 can convey energy to the working fluid that is operable in initiating combustion of at least a portion of the working fluid.

A non-exhaustive list of examples of the energy source 11 can include a thermal energy source, an electrothermal energy source, a combustion energy source, a kinetic energy source, a chemical energy source, and/or any other suitable energy source or a combination thereof. In some embodiments, the energy source 11 can be based at least in part on a working fluid configured to flow through the launcher 10. For example, in implementations in which the working fluid is a non-combustible propellant, the energy source 11 can be a thermal energy source configured to increase a temperature of the working fluid by way of a heating device, filament, element, and/or the like; an electrothermal energy source configured to increase a temperature of the working fluid by way of an electrical current, arc, and/or the like; a kinetic energy source configured to rapidly compress a volume of the working fluid (e.g., similar to a two-stage light-gas gun or the like); and/or any other suitable energy source. In implementations in which the working fluid is a combustible solid propellant or a combustible liquid propellant, the energy source 11 can be a combustion device, an ignition device, an impact-sensitive primer, a firing pin, a detonator, a trigger, and/or any other suitable energy source.

Although not shown in FIG. 1, in some embodiments, the launcher 10 can include a chamber and/or vessel that is in fluid communication with the expansion structure 12. In some embodiments, such a chamber and/or vessel (referred to herein as "chamber" for simplicity) can be included in, integrated into, and/or otherwise formed by the expansion structure 12. In other embodiments, the chamber can be physically and fluidically coupled to the expansion structure 12. For example, the chamber can be formed independent of the expansion structure 12 and later fixedly or removably coupled to the expansion structure 12. As described in further detail herein, the chamber can be configured to at least temporarily contain and/or store a working fluid that is accelerated through the expansion structure 12 to generate the supersonic free jet.

The expansion structure 12 can be any suitable shape, size, and/or configuration. Similarly, the expansion structure 12 can be formed from and/or by any number of parts, components, and/or combination of features. In some embodiments, the expansion structure 12 can be monolithically and/or unitarily constructed. In other embodiments, the expansion structure 12 can include any number of parts that are formed separately and later fixedly or removably coupled to collectively form the expansion structure 12. Moreover, the expansion structure 12 and/or parts, components, or features thereof can be formed from or of any suitable material. For example, in some embodiments, the expansion structure 12 and/or parts, components, or features thereof can be formed from or of ceramics, metal alloys, polymers, or composites combining two or more of those materials. In some embodiments, the materials can have one or more properties, characteristics, surface finishes, and/or the like configured to result in a fluid flow having one or more desired characteristics.

The expansion structure 12 can have an inlet and an outlet. The inlet can be coupled to and/or otherwise in fluid communication with the chamber configured to at least temporarily contain the working fluid (not shown in FIG. 1). For example, the inlet of the expansion structure 12 can be physically coupled to the chamber and/or otherwise disposed adjacent to the chamber such that the inlet is or can be placed in fluid communication with an inner volume of the chamber (e.g., via an opening, aperture, hole, port, valve, conduit, throat, and/or the like). Although not shown in FIG. 1, in some embodiments, the chamber and/or the inlet of the expansion structure 12 can include a closure member configured to temporarily fluidically isolate the inner volume of the chamber from the inlet of the expansion chamber 12. In some embodiments, the closure member can be a pressure-dependent valve, port, membrane, film, member, and/or the like. For example, in some embodiments, the closure member can be a frangible member or seal that can be transitioned from a closed, sealed, or undeformed state or configuration to an open, unsealed, or deformed state or configuration in response to a pressure of the working fluid disposed in the chamber exceeding a threshold pressure. Said another way, the closure member can be configured to rupture when a pressure within the chamber and/or otherwise associated with the working fluid exceeds a predetermined and/or desired pressure threshold. In some embodiments, such a pressure threshold can be, for example, about twice the ambient atmospheric pressure. In other embodiments, such a pressure threshold can be between one-two times the ambient atmospheric pressure. In still other embodiments, the pressure can be as high as the strength of the material of which the expansion chamber 12 is composed will allow (e.g., approximately 600 MPa for a steel pressure vessel).

In some embodiments, the expansion structure 12 can be and/or can function as a nozzle or the like configured to receive a flow of fluid (e.g., the working fluid) via the inlet and to eject, expel, and/or otherwise produce a flow of the fluid through the outlet. Moreover, the expansion structure 12 (e.g., nozzle) can have any suitable inner shape, contour, and/or configuration such that the flow of the fluid exits the outlet of the expansion structure 12 with a desired set of characteristics. For example, in some embodiments, the expansion structure 12 can be a divergent nozzle in which an inner surface of the expansion structure 12 diverges from a first size or diameter at or near the inlet to a second size or diameter at or near the outlet. In some such embodiments, the inlet of the expansion structure 12 can form a throat of the nozzle. In other embodiments, a portion of an inner surface of the expansion structure 12 that is adjacent to and/or otherwise near the inlet can form the throat of the nozzle. In some instances, the expansion structure 12 (arranged as a divergent nozzle) can be characterized by a ratio of a size or diameter of the outlet relative to a size or diameter of the throat or inlet (referred to herein as "expansion ratio"). For example, in some embodiments, the expansion structure 12 can have an expansion ration between 1 and 8.

While the expansion structure 12 is described above as forming a divergent nozzle, in other embodiments, the expansion structure 12 can be configured and/or arranged to form any suitable nozzle or structure. For example, the expansion structure 12 can include an inner surface that forms a convergent-divergent nozzle (also referred to as a "de Laval nozzle") and/or any other suitable nozzle or structure. In some embodiments, the expansion structure 12 can form any suitable nozzle and/or structure (such as those described above) configured to allow a flow of pressurized fluid (e.g., gas) to expand as the pressurized fluid flows from the inlet to the outlet of the expansion structure 12. Moreover, the arrangement of the expansion structure 12 can be such that as the pressurized fluid expands, a velocity of the pressurized fluid increases to rates greater than the speed of sound for a given altitude or ambient pressure. Said another way, the expansion structure 12 can be any suitable nozzle or structure configured to produce a supersonic flow of the pressurized gas.

In some embodiments, the expansion structure 12 can be configured to produce and/or otherwise result in an underexpanded supersonic jet of the pressurized gas exiting the outlet of the expansion structure 12. In this context, the term "underexpanded" refers to a jet (e.g., a flow of fluid) exiting the outlet of the expansion structure 12 (or any other nozzle or the like) with a pressure above a pressure of the ambient surroundings. In some instances, it may be desirable to generate an underexpanded supersonic jet based at least in part on one or more characteristics of the flow and/or the ability of the jet to accelerate an object (e.g., the projectile 13).

Figure 2:
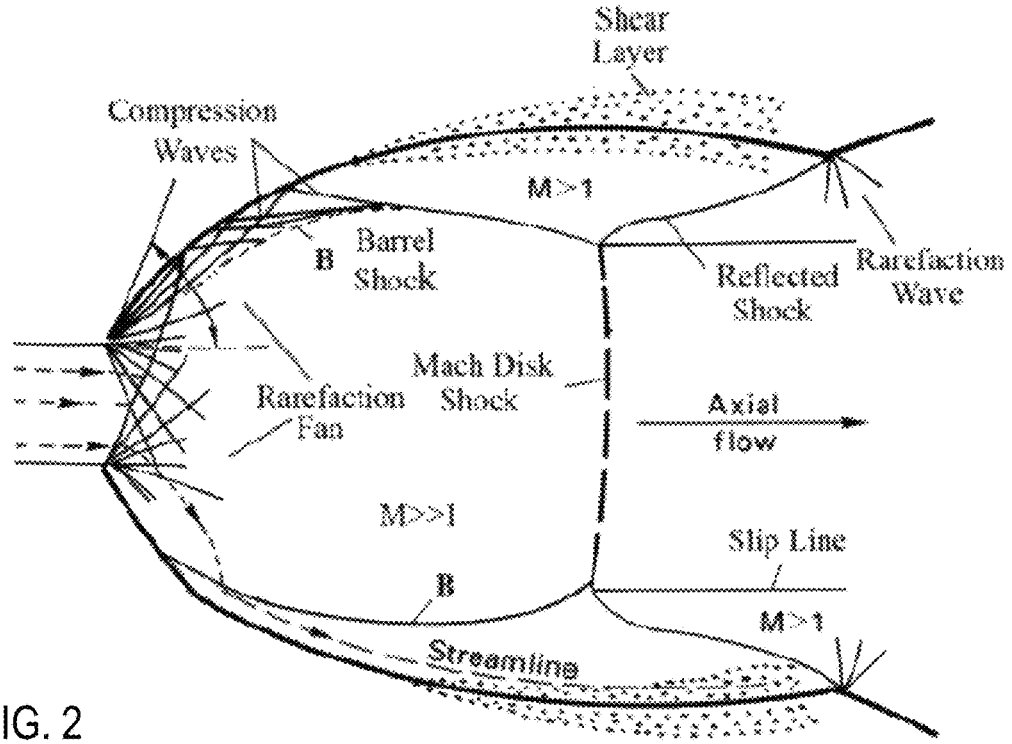
FIG. 2 is an illustration of a shock structure resulting from a supersonic jet of fluid.

In general, the flow of a supersonic free jet results in shock structure, as shown, for example, in FIG. 2. The shock structure can have any number of regions, with each region having a set of characteristics. When a supersonic flow exits a nozzle (e.g., the expansion structure 12) a supersonic expansion fan is formed at the edge or lip of the nozzle outlet. The expansion fan (also known as "Prandtl-Meyer expansion"), in turn, can be reflected off of the jet boundary as compression waves, which can merge to form a barrel shock region of the shock structure. The barrel shock region converges from the jet boundary toward an axis of the jet until the barrel shock region is terminated by a termination or normal shock wave (e.g., also referred to as a "Mach disk shock," as shown in FIG. 2). The flow in the barrel shock region is and/or can be considered inviscid (i.e., having no viscosity) and isentropic (i.e., having constant entropy) and thus, it may be desirable to accelerate the projectile 13 in the barrel shock region of the shock structure.

In an underexpanded supersonic jet, a portion of the jet continues to expand as the jet exits the outlet of the nozzle (e.g., the outlet of the expansion structure 12). In some instances, the continued expansion of the portion of the jet can redirect streamlines in the flow away from the jet axis, thereby increasing a Mach number of a portion of the jet at or near the axis (e.g., within the barrel shock region as shown in FIG. 2). Moreover, underexpanded supersonic jets have a larger barrel shock region than a normal supersonic jet and/or an overexpanded supersonic jet. Accordingly, in some instances, it may be desirable to accelerate the projectile in a barrel shock region of an underexpanded supersonic free jet.

As described in further detail herein, the supersonic free jet generated by the launcher 10 is configured to contact and/or stagnate against a surface of the projectile 13 to accelerate the projectile 13. The projectile 13 can be any suitable object having any suitable mass, size, and/or configuration. More particularly, because the flow between the launcher 10 (e.g., the outlet of the expansion structure 12) and the projectile 13 is supersonic, changes in the projectile 13 do not propagate back to the launcher 10. The terminal velocity of the projectile 13 is dependent on the velocity of the supersonic jet as it exits the expansion structure 12 (also referred to as an "exhaust velocity") and is inversely dependent on the density of the projectile 13. As such, the launcher 10 can be used to accelerate a payload (e.g., the projectile 13) having any mass and/or size.

In some embodiments, the projectile 13 can be a single object, projectile, payload, etc. In other embodiments, the projectile 13 can be an object formed from any number of independent parts or components that collectively form the projectile 13. In some such embodiments, the parts or components can be coupled together and can remain coupled together during acceleration. In other embodiments, the projectile 13 can include one or more parts, components, and/or portions configured to separate from the remaining parts of the projectile 13 during acceleration. For example, in some embodiments, the projectile 13 can include first object having a relatively small surface area and/or cross-sectional size and a second object having a relatively large surface area and/or cross-sectional size. More particularly, in some embodiments, the projectile 13 can include a sabot and/or any other suitable structure configured to have a relatively large surface area against which a portion of the underexpanded supersonic free jet can stagnate. In such embodiments, when a distance between the outlet of the expansion structure 12 (e.g., an exit plane) and a surface of the sabot exceeds a threshold distance, a pressure resulting from a drag force exerted on the sabot can become greater than a pressure resulting from the supersonic jet stagnating against the surface of the sabot, thereby resulting in a separation of the sabot from the remaining portion of the projectile 13, as described in further detail herein.

In some instances, the projectile 13 can be any suitable object or payload intended to be placed into or beyond Earth's orbit. In other words, the launcher 10 can be configured to accelerate the projectile 13 to a velocity that is equal to or greater than an escape velocity of the projectile 13. In such instances, the projectile 13 can be a satellite and/or any other device or equipment, cargo or supplies, one or more fuel containers of tanks, a manned or unmanned spacecraft, and/or any other suitable object or payload. In other instances, the projectile 13 can be, for example, a bullet, shell, round, artillery, munition, and/or the like. In still other instances, the projectile 13 can be any other suitable object or payload such as disks, hemispherical shells, conical shells, and/or the like.

As shown in FIG. 1, in some embodiments, the launcher 10 can optionally include a projectile support 14 configured to at least temporarily support the projectile 13 prior to the projectile being accelerated. For example, in some embodiments, the projectile support 14 can be temporarily coupled to the projectile 13 and can retain the projectile 13 is a desired position relative to the outlet of the expansion structure 12. In some embodiments, the desired position can be a position in which the projectile 13 is substantially aligned with the outlet of the expansion structure 12. In some embodiments, the projectile support 14 can temporarily support and/or maintain the projectile 13 in a position in which a surface of the projectile 13 is adjacent to and/or in contact with the outlet of the expansion structure 12. In other embodiments, the projectile support 14 can temporarily support and/or maintain the projectile 13 in a position in which the projectile 13 is spaced apart from the outlet of the expansion structure 12. In such embodiments, the distance between the outlet of the expansion structure 12 and the projectile 13 can be less than a distance or length associated with a barrel shock generated by the supersonic free jet, as described in further detail herein.

A non-limiting example of using the launcher 10 to accelerate the projectile 13 is described below. In some instances, the launcher 10 can be prepared for use by conveying a volume of a compressible gas or a propellant (e.g., a combustible propellant or a non-combustible propellant) configured to generate a compressible gas into the chamber and/or vessel of the launcher 10 (not shown in FIG. 1). In some instances, the compressible gas and/or the propellant (referred to herein as "gas," for simplicity) can be conveyed into the chamber via, for example, a port or inlet. Moreover, in such instances, the closure member configured to temporarily isolate the chamber from the expansion structure 12 can be in a closed state, thereby allowing a desired volume and/or amount of the gas to be conveyed into the chamber. In other instances, the gas can be conveyed into the chamber via, for example, the expansion structure 12. In such instances, the closure member can be transitioned to an open state to allow the gas to be conveyed into the chamber. Once the desired volume and/or amount of the gas is conveyed into the chamber, the closure member can be transitioned to the closed state.

Before or after conveying the gas into the chamber, the projectile 13 can be placed in a desired position relative to the outlet of the expansion structure 12. In some embodiments, for example, the projectile 13 can be temporarily coupled to the projectile support 14, which in turn, can maintain the projectile 13 in the desired position. In other embodiments, the projectile 13 can be placed in the desired position without the projectile support 14. For example, the projectile 13 can be aligned with and set on the outlet of the expansion structure 12.

With the desired volume and/or amount of the gas contained in the chamber and with the projectile 13 in the desired position relative to the outlet of the expansion structure 12, the energy source 11 can be manipulated to transfer an amount of energy to the gas. As described above, the energy source 11 can convey, exert, and/or discharge thermal energy, electrical energy, chemical energy, kinetic energy, and/or the like into or on the gas disposed in the chamber such that an internal energy and/or enthalpy of the gas is rapidly increased. Said another way, the energy source 11 can discharge any suitable form of energy into the chamber and/or the gas, which in turn, results in a rapid increase in a temperature and/or pressure associated with the gas. For example, in some instances, the energy source 11 can discharge thermal energy into the gas that results in an increase in a temperature of the gas. The increase in temperature of the gas, in turn, results in an associated increase in a pressure of the gas (e.g., gaseous products released by combustion of a propellant). For example, the relationship of between temperature and pressure of the gas can be described by Equation (1) below:

$$\frac{P_1 V_1}{T_1} = \frac{P_2 V_2}{T_2} \quad \text{Equation (1)}$$

Where P is the pressure of the gas, V is the volume of the gas, and T is the temperature of the gas. Accordingly, for an isochoric process (e.g., a process in which the volume V is constant), an increase in the temperature T of the gas results in a corresponding increase in pressure P.

As described above, the closure member is configured to transition from the closed or sealed state to an open state in response to a pressure within the chamber (e.g., a pressure associated with the gas) exceeding a predetermined and/or desired threshold. Accordingly, the energy source 11 can be configured to discharge a sufficient amount of energy into the chamber and/or the gas to result in a pressure sufficient to transition the closure member from the closed state to the open state.

In response to the closure member being transitioned to the open state, the pressurized and/or high-enthalpy gas can flow through the expansion structure 12 from the inlet to the outlet. As described in detail above, the expansion structure 12 can be configured and/or arranged as a divergent nozzle, a convergent-divergent nozzle, and/or the like. Thus, the expansion structure 12 allows the gas to expand as the gas flows from the inlet (or throat) to the outlet. The expansion of the gas, in turn, results in a flow rate that is greater than the speed of sound associated with the ambient pressure (or given altitude). As such, an exhaust flow of the gas (e.g., a flow of the gas exiting the outlet of the expansion structure 12) can be a supersonic free jet.

As described in detail above, in some embodiments, the expansion structure 12 can be configured such that the supersonic free jet exiting the outlet of the expansion structure 12 is underexpanded. The projectile 13 can be at least temporarily positioned relative to the expansion structure 12 such that the projectile 13 is within the flow of the supersonic free jet. More specifically, the projectile 13 can be disposed within the barrel shock region of the supersonic free jet. As such, at least a portion of the flow within the barrel shock region can stagnate against a surface of the projectile 13, thereby resulting in a thrust that accelerates the projectile 13. In addition, thrust may be generated by redirecting at least some of the flow of the supersonic free jet after the jet has impacted, stagnated against, and/or otherwise been intercepted by the surface of the projectile 13. In some instances, increasing a pressure associated with the stagnation of the jet against the surface of the projectile 13 (also referred to herein as "stagnation pressure") and/or redirecting a portion of the jet in a desirable direction, manner, or way can result in a corresponding, predictable, and/or proportional increase thrust, as described in further detail herein.

In some instances, an acceleration path can be defined, at least in part by the barrel shock. Said another way, the supersonic free jet can accelerate the projectile 13 while the projectile 13 is within the barrel shock region. In some instances, the flow characteristics of the supersonic free jet outside or beyond the barrel shock limit and/or substantially prevent the jet from imparting additional acceleration on the projectile 13. Accordingly, in some instances, it may be desirable to generate an underexpanded supersonic free jet having a sufficiently long barrel region to allow for a desired length of the acceleration path. A length of the barrel shock region can be expressed and/or approximated using Equation (2) below:

$$L = D_E \sqrt{\frac{k}{2} * \frac{P_E}{P_{amb}} * M_E^2} \quad \text{Equation (2)}$$

Where L is the length of the barrel shock region, $D_E$ is the outlet diameter of the expansion structure 12 (e.g., nozzle), $P_E/P_{amb}$ is the static pressure ratio at the outlet of the expansion structure 12, and $M_E$ is the Mach number of the jet at the outlet of the expansion structure 12.

As such, in some implementations, the barrel shock length can be based at least in part on a stagnation pressure of the supersonic jet, which in turn, is based at least in part on the increase in pressure of the gas in response to the discharge of energy by the energy source 11. In some instances, a length of a barrel shock can be up to fifty times the outlet diameter of the expansion structure 12 or more. In some implementations, any of the embodiments and/or features of the embodiments described herein can be used to increase a length of the barrel shock region and/or to otherwise produce one or more jets (e.g., a supersonic free jet, a hypersonic free jet, and/or a combination of a supersonic free jet and a hypersonic free jet) having a relatively long barrel shock region.

As described above, thrust exerted on the projectile is produced by (1) the stagnation of the free jet against the surface (e.g., a base surface) of the projectile 13 and (2) the redirection of the free jet (e.g., by the base surface of the projectile 13 or by any other suitable means). The thrust produced by the stagnation of the free jet against the projectile 13 is proportional to the pressure of the stagnated jet (referred to herein as the "recovery pressure") and can be expressed and/or approximated using Equation (3) below. The thrust produced by the redirection of the free jet is proportional to the square root of the temperature of the stagnated jet (referred to herein as the "recovery temperature") and can be expressed and/or approximated using Equation (4) below.

$$P_{recovery} = P_o(1 - X^2)^{\frac{k}{k-1}} \quad \text{Equation (3)}$$

$$T_{recovery} = T_o(1 - X^2) \quad \text{Equation (4)}$$

Where X is the velocity of the projectile 13 divided by the velocity of the free jet, $P_o$ is a pressure existing in a chamber of the launcher 10, $T_o$ is a temperature existing in the chamber of the launcher 10, and k is a ratio of specific heats of the gases in the free jet.

Figure 3:
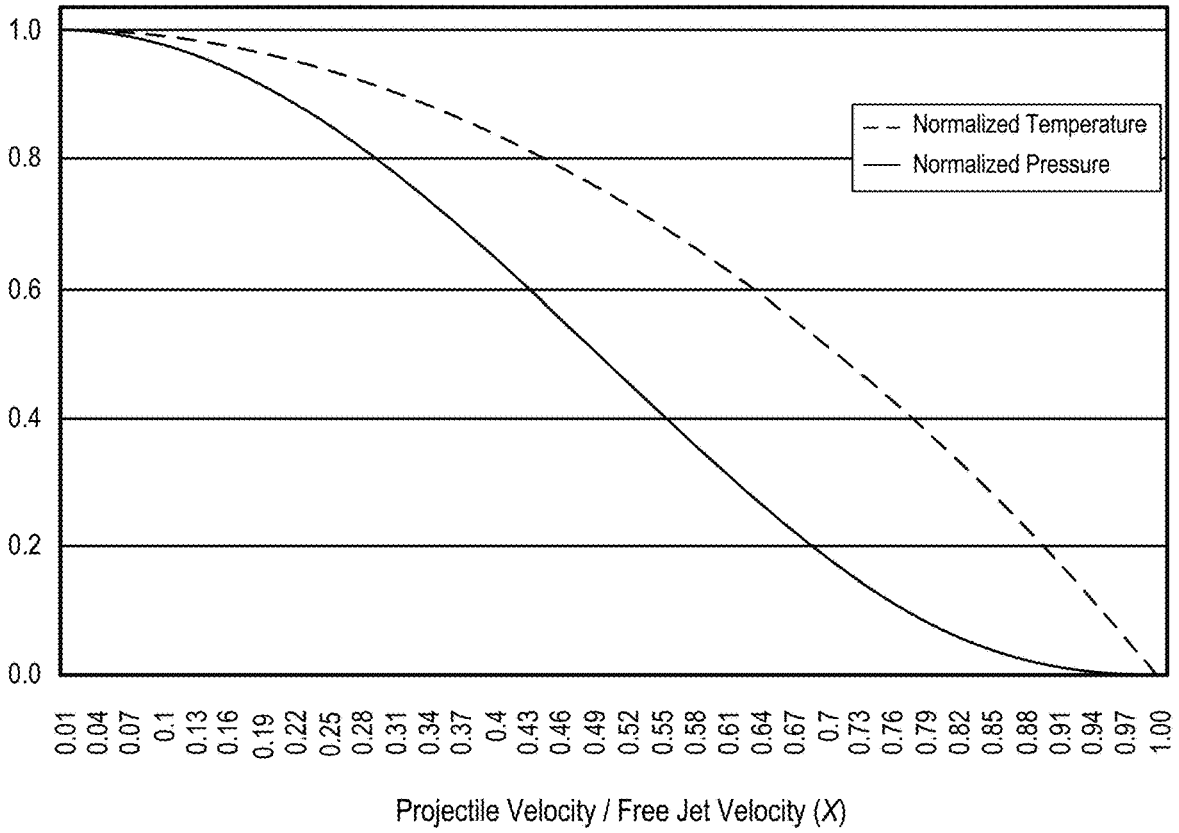
FIG. 3 is a chart illustrating a relationship between a ratio of projectile velocity to free jet velocity and (i) a normalized temperature of the free jet and (ii) a normalized pressure of the free jet, according to an embodiment.

As shown in Equations (3) and (4), an increase in X results in a decrease in the recovery pressure and the recovery temperature. The recovery temperature, however, is not dependent of the ratio of the specific heats of the gases in the free jet (k) and thus, the recovery temperature of the free jet falls more slowly than the recovery pressure of the free jet in response to an increase in X. For example, FIG. 3 illustrates a graph showing a relationship between a normalized temperature and the ratio of projectile velocity to free jet velocity (X) and a relationship between a normalized pressure and the ratio X (the normalized temperature is represented by the dashed line, the normalized pressure is represented by the solid line, and the ratio X is shown along the x-axis).

At high values of X, therefore, thrust derived from the redirection of the free jet (e.g., thrust associated with the recovery temperature) is greater than thrust derived from the stagnation of the free jet against the projectile 13 (e.g., thrust associated with the recovery pressure). In some instances, it can be desirable to generate as much thrust as possible at a highest possible value of X (e.g., when a difference between a velocity of the free jet and a velocity of the projectile 13 is relatively small). Moreover, in some instances, lower free jet velocities can be associated with lower technical risks resulting from the production of the free jet (e.g., lower pressures, lower temperatures, lower energy, and/or the like). Thus, in some implementations, a projectile, a surface of a projectile, and/or a sabot used in conjunction with a projectile can be shaped, sized, and/or otherwise configured in any suitable manner to redirect at least a portion of the free jet to increase and/or substantially maximize an amount of thrust associated with and/or resulting from the recovery temperature (e.g., the redirection of the flow).

In some instances, the thrust associated with the recovery pressure and/or the thrust associated with the recovery temperature can be independent of a pressure within the chamber of the launcher 10. For example, thrust is a force which can be expressed as force=mass*acceleration. The thrust associated with the recovery pressure—in other words, the thrust exerted on the surface of the projectile 13 by the stagnation of the free jet—is equal to the stagnation pressure of the free jet on the surface of the projectile 13 multiplied by the area of the surface of the projectile 13 on which the pressure acts (e.g., pressure=force/area or force=pressure*area). The area of the surface of the projectile 13 on which the pressure acts is or can be equal to the throat area of the expansion structure 12 of the launcher 10 (e.g., the throat area of the nozzle). As such, for a given amount of thrust produced by the launcher 10, if a static pressure of the free jet at an exit of the expansion structure 12 is held constant while a pressure in the chamber of the launcher 10 is decreased, a resulting stagnation pressure of the free jet on the surface of the projectile 13 will decrease and the throat area of the expansion structure 12 will increase. The increase in area and decrease in pressure can, in some instances, cancel out such that the thrust exerted on the projectile 13 remains constant.

The thrust associated with the recovery temperature—in other words, the thrust exerted on the surface of the projectile 13 by the redirection of the free jet—is equal to the velocity of the redirected free jet multiplied by the mass flow rate of the gas in the free jet relative to the surface of the projectile 13. If it is assumed that (i) a temperature of the gas in the chamber is constant regardless of a pressure in the chamber of the launcher 10, thereby resulting in a constant speed of sound within the launcher 10, and (ii) the velocity of the gas through the throat of the expansion structure 12 is equal to the speed of sound in the gas at the throat, then a mass flow rate of the gas can be expressed and/or approximated using Equation (5) below:

$$\dot{m}=\rho^{*}A_{throat} \qquad \text{Equation (5)}$$

Where $\dot{m}$ is the mass flow rate of the gas, $\rho$ is the density of the gas traveling through the throat of the expansion structure 12, and $A_{throat}$ is the area of the throat of the expansion structure 12.

Figure 4:
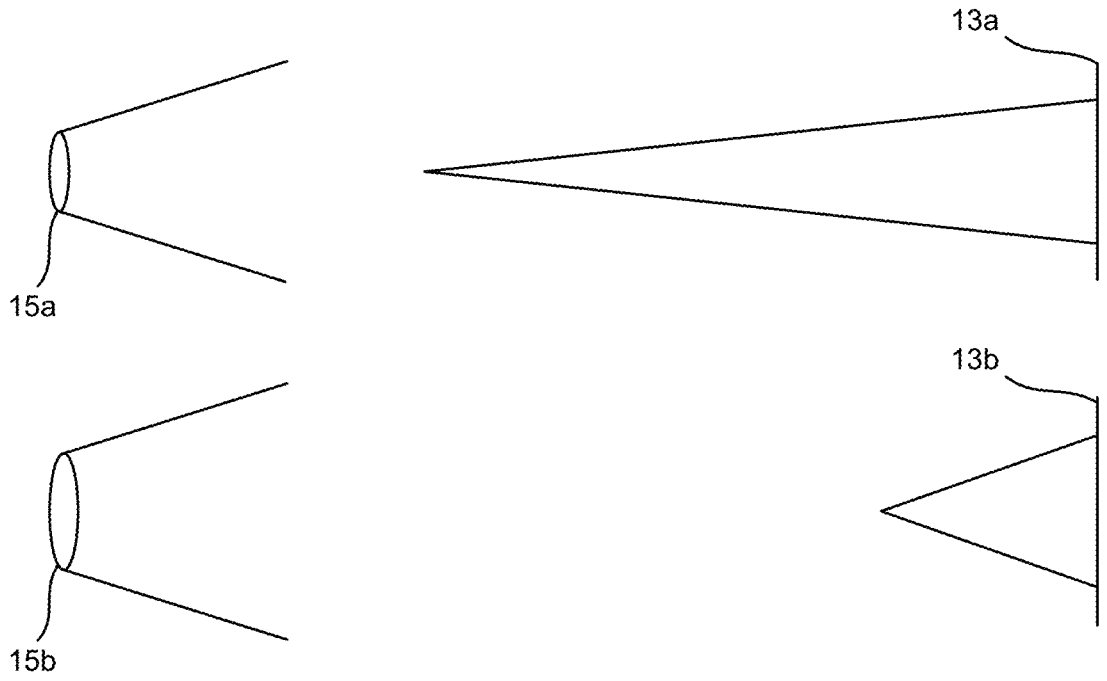
FIG. 4 is a schematic illustration showing a relationship between a throat area of an expansion structure of a projectile launcher and density of a portion of the free jet stagnated against a projectile, according to an embodiment.

Thus, if thrust produced by the launcher 10 and a static pressure at of the free jet at an exit of the expansion structure 12 are held constant (and thus, constant velocity) while a pressure in the chamber of the launcher 10 is decreased, the density of the gas ($\rho$) will decrease and the throat area $A_{throat}$ will increase, as illustrated in FIG. 4 by the throat areas 15*a* and 15*b* and the corresponding free jets stagnating against the projectiles 13*a* and 13*b*, respectively. The reduction in the density $\rho$ and the increase in the throat area $A_{throat}$ cancel out such that the mass flow rate $\dot{m}$ remains constant (e.g., the density $\rho$ of the free jet stagnating against the projectile 13*a* is greater than the density $\rho$ of the free jet stagnating against the projectile 13*b* and the area of the throat 15*b* is greater than the area of the throat 15*a*). Accordingly, when the mass flow rate is constant, the thrust remains constant.

As described above, in some instances, the flow characteristics of the free jet outside of or beyond the barrel shock region can limit and/or can substantially prevent the free jet from imparting additional acceleration on the projectile 13. More specifically, shocks in the flow of the supersonic free jet reduce and/or limit a recovery pressure that can be achieved through the stagnation of the free jet against the surface of the projectile 13. In some instances, however, the shocks in the flow of the supersonic free jet do not reduce the recovery temperature that can be achieved through stagnation. Accordingly, thrust associated with and/or dependent on the recovery temperature, rather than the recovery pressure, is not limited and/or reduced by shocks appearing in the flow of the free jet (e.g., the flow outside of or beyond the barrel shock region). Therefore, a projectile, a surface of a projectile, and/or a sabot used in conjunction with a projectile can be configured to redirect at least a portion of the flow of the free jet such that the free jet still exerts thrust on the projectile (or sabot) after transitioning through several barrel shock regions, each of which is terminated by a normal shock (see e.g., FIG. 2). In some implementations, a free jet which is not limited to a single barrel shock region can have a substantially higher aspect ratio (length (L)/diameter (D)) and therefore, can launch projectiles at lower accelerations (e.g., due to the increased length of the acceleration path). In some instances, the lower acceleration can broaden the range of possible payloads (projectiles) and can reduce a size and/or a power of the launcher (e.g., the launcher 10).

In some implementations, any of the embodiments and/or methods described herein can be configured to produce a free jet having a desired aspect ratio (e.g., L/D), which in some instances, can be greater than an aspect ratio of a free jet produced via other means. In other words, any of the embodiments and/or methods described herein can be used to generate a free jet having an elongated barrel shock region. In some instances, a free jet having an elongated barrel shock region can have a desired aspect ratio without transitioning through two or more barrel shock regions.

For example, the structure of a barrel shock region (see FIG. 2) is defined by the expansion of the free jet to a pressure below the surrounding atmospheric pressure. The expansion of the free jet is then followed by a recompression of the free jet, which terminates in a shock (e.g., identified in FIG. 2 as the "Mach Disk Shock"). In some instances, a line associated with (e.g., aligned with or tangential to) at least a portion of the free jet during expansion can form a "divergence angle" relative to the axial flow direction of the jet while a line associated with (e.g., aligned with or tangential to) at least a portion of the free jet during recompression can form a "convergence angle" relative to the axial flow direction of the jet. The difference between the divergence angle and the convergence angle can be associated with, indicative of, and/or can otherwise determine the aspect ratio (e.g., L/D) of the free jet. Moreover, the difference between the divergence and convergence angles (e.g., the aspect ratio) is inversely dependent on a Mach number (e.g., a ratio of the speed of the jet relative to the local speed of sound) associated with the flow of the free jet.

The expansion and recompression of the flow of the free jet is based at least in part on the interaction of the free jet at the boundaries with the atmosphere. Accordingly, it may be desirable to shield, protect, insulate, guide, etc. the flow of the jet. For example, in some known launchers, a supporting structure or barrel can shield the jet flowing therethrough. The embodiments and/or methods described herein, however, produce a free jet that flows outside of such structural support. As described in further detail herein with reference to specific embodiments, one method of "shielding" a flow of a free jet is to surround or shield the flow of the free jet (e.g., a first jet) with a flow of an annular free jet (e.g., a second jet) having a relatively high Mach number. For example, in some embodiments, a launcher (e.g., the launcher 10) can be configured to produce a supersonic free jet having a relatively low Mach number (e.g., a core jet) and, for example, an annular hypersonic free jet having a relatively high Mach number configured to flow around the core jet. In some instances, the core jet can have a Mach number of about 3 and the annular jet can have a Mach number of about 9. In some instances, the annular hypersonic and/or high-Mach number jet can be operative to elongate the barrel shock region of the supersonic and/or low-Mach number jet (e.g., can increase the aspect ratio of the core jet).

In some implementations, it may be desirable to have two separate free jets (as just described), each of which can be produced by a launcher or a portion of a launcher (such as those described herein) configured and/or optimized to produce such jets. For example, some known systems and/or methods for producing a supersonic jet via gas-dynamic expansion may not be suitable for producing jets having a Mach number of 9 or more. By way of example, producing a jet having a Mach number of 9 or more via gas-dynamic expansion through an expansion structure or nozzle having an exit pressure at or above atmospheric pressure (e.g., about 100 kilopascals (kPa)) exceed pressure limitations of at least some known pressure vessels.

In some embodiments, a launcher (e.g., the launcher 10) can be configured to produce a jet having a high Mach number via, for example, two-phase flow. More particularly, in some instances, incompressible particles can be included in and/or introduced into a compressible gas, which in turn, will change the effective molecular weight of the gas. In some implementations, incompressible particles can be, for example, combustion products generated by the propellant such as, for example, particles of one or more metal oxides and/or the like. The effective molecular weight of the gas can be expressed and/or approximated using Equation (6) below:

$$M_{eff}=M_{gas}*(1+m) \quad \text{Equation (6)}$$

Where $M_{eff}$ is the effective molecular weight of the gas, $M_{gas}$ is the mass of the gas, and m is the mass of particles entrained in the gas divided by the mass of the gas.

The speed of sound is proportional to the effective molecular weight of a gas, as shown in Equation (7) below:

$$\text{Speed of Sound} \propto \sqrt{(1/M_{eff})} \quad \text{Equation (7)}$$

Accordingly, a Mach number of a gas moving at a constant velocity can be increased in response to the addition of incompressible particles into the flow of the gas. In some instances, the achievable Mach number can be dependent on the maximum load of incompressible particles that can be carried by or in the flow of the gas rather than, for example, a pressure in a chamber from which the pressurized gas flows.

Additional examples of projectile launchers are described below with reference to specific embodiments. While embodiments may be described herein as including particular features and/or characteristics, it should be understood that the embodiments are presented by way of example only and not limitation. Accordingly, other embodiments are possible having any suitable combination of the features and/or characteristics described below and/or any other suitable features and/or characteristics.

Figure 5:
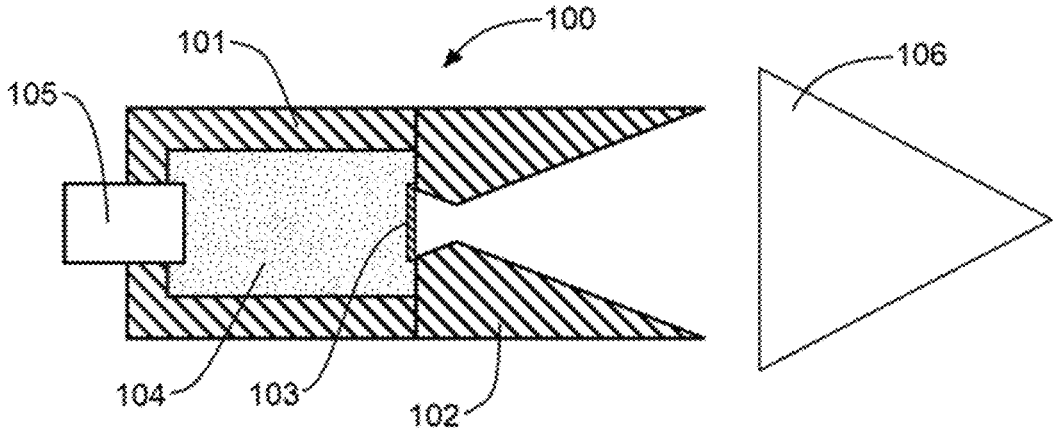
FIG. 5 is a cross-sectional view of a projectile launcher according to an embodiment.

FIG. 5 illustrates a projectile launcher 100 according to an embodiment. The projectile launcher 100 (also referred to herein as "launcher") includes a cylindrical chamber 101 which is connected to a nozzle 102. In some embodiments, the chamber 101 can be similar to and/or substantially the same as the chamber described above with reference to the launcher 10 shown in FIG. 1. In some embodiments, the nozzle 102 can be similar to or substantially the same as the expansion structure 12 described above with reference to FIG. 1. In some embodiments, the nozzle 102 can be, for example, a convergent-divergent nozzle.

A throat or inlet of the nozzle 102 is at least temporarily blocked by a closure member 103. In some implementations, the closure member 103 can be similar to or substantially the same as the closure member described above with reference to the launcher 10 shown in FIG. 1. For example, in some embodiments, the closure member 103 can be a frangible member configured to break or rupture. In other embodiments, the closure member 103 can be a movable member and/or a member otherwise configured to transition between a closed state and an open state.

The chamber 101 receives and at least temporarily contains a propellant 104. The propellant 104 can be any suitable propellant and/or compressible gas such as those described above with reference to the launcher 10 shown in FIG. 1. In some implementations, the propellant 104 can receive thermal energy from a heating device 105 operably coupled the chamber 101. In other implementations, the propellant 104 can be combustible and the heating device 105 is used to ignite the propellant 104. In other implementations, the propellant 104 can receive any suitable form of energy from any suitable energy source such as the energy source 11 described above with reference to FIG. 1.

As shown in FIG. 5, a projectile 106 can placed in front of an exit plane of nozzle 102. The projectile 106 can be any suitable projectile. For example, in some embodiments, the projectile 106 can be similar to or substantially the same as the projectile 13 described above with reference to FIG. 1.

In use, the launcher 100 can engaged, activated, and/or otherwise initiated such that the heating device 105 conveys and/or discharges thermal energy into the propellant 104 contained in the chamber 101. In response to the thermal energy, a pressure associated with the propellant 104 and/or products resulting from the combustion of the propellant 104 can be increased to an extent sufficient to transition the closure member 103 from the closed state to the open state (e.g., rupture, break, and/or otherwise open). Accordingly, the pressurized and/or high-enthalpy propellant 104 can flow through the nozzle 102, allowed to expand, and then exhausted through the exit or outlet of the nozzle 102 as, for example, an underexpanded supersonic free jet. Accordingly, the launcher 100 can be used to accelerate the projectile 106 in a manner substantially similar to the manner described above with reference to the launcher 10.

Figure 6:
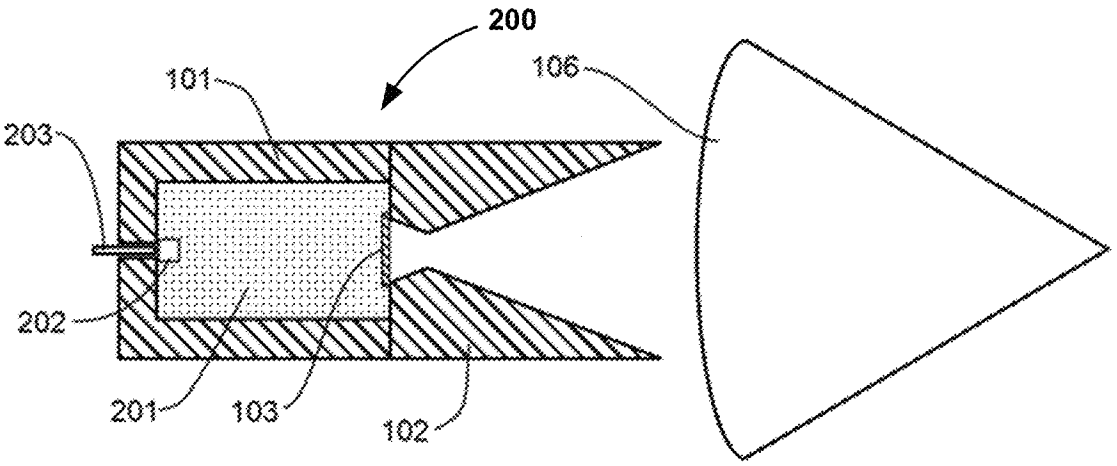
FIGS. 6 and 7 are cross-sectional views of a projectile launcher according to an embodiment, shown in a first state and a second state, respectively.
Figure 7:
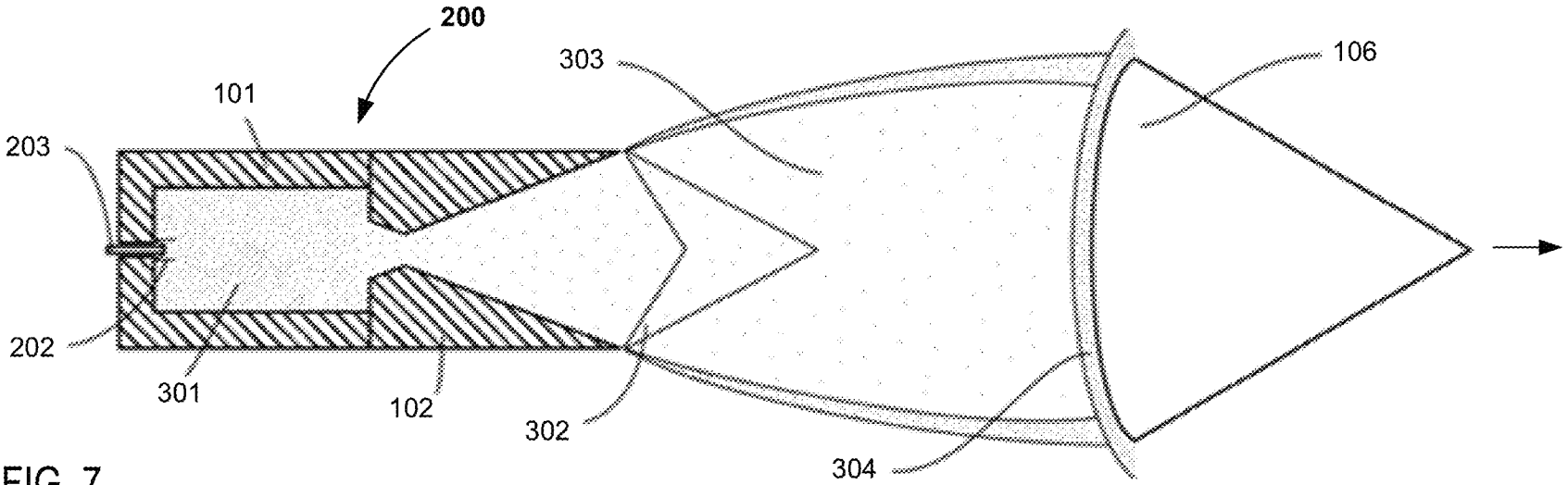

FIGS. 6 and 7 illustrate a projectile launcher 200 according to an embodiment. In some embodiments, the projectile launcher 200 (also referred to herein as "launcher") and/or portions thereof can be substantially similar to the projectile launchers 10 and/or 100 described above. In the embodiment shown in FIGS. 6 and 7, the launcher 200 can be configured for use with a combustible solid propellant 201. As described above with reference to the launcher 100, the launcher 200 includes the chamber 101, the nozzle 102, the closure member 103, and the projectile 106.

In the embodiment shown in FIGS. 6 and 7, however, the chamber 101 is filled with the combustible solid propellant 201. In some embodiments, the combustible solid propellant 201 can be, for example, a double-based propellant. In some such embodiments, the combustible solid propellant 201 can include, for example, nitrocellulose and nitroglycerin and/or any other suitable nitrate explosive. In other embodiments, the combustible solid propellant 201 can be any suitable solid propellant and/or combination of solid propellants. Moreover, an impact-sensitive primer 202 can be operably coupled to the chamber 101 and used to initiate combustion of the combustible solid propellant 201. In some embodiments, the impact-sensitive primer 202 can be initiated, activated, and/or otherwise primed by a firing pin 203 operably coupled thereto. In other embodiments, the launcher 200 can include any other suitable device, mechanism, and/or mode of initiating a combustion of the combustible solid propellant 201.

In use, the firing pin 203 can be engaged to trigger the primer 202. The primer 202, once triggered, can initiate combustion in and/or of the combustible solid propellant 201, which in turn, results in combustion products 301, as shown in FIG. 7. The combustion products result in a pressure rise in the chamber 101 that is sufficient to transition (e.g., rupture) the closure member 103 from the closed state to the open state, allowing the combustion products 301 (e.g., having a high pressure and/or high enthalpy) to expand through the nozzle 102, as described in detail above with reference to the expansion structure 12.

In some instances, the resulting supersonic jet of the combustion products 301 can remain above atmospheric pressure at the exit plane of the nozzle 102. Said another way, the resulting supersonic jet of the combustion products 301 can be underexpanded as the jet flows through the exit plane of the nozzle 102. As described in detail above with reference to the launcher 10 shown in FIG. 1, the underexpanded supersonic jet undergoes a Prandtl-Meyer expansion as a result of the exiting a boundary, surface, and/or plane of the nozzle 102 (shown in FIG. 7 as region 302). In some instances, the expansion of the supersonic jet can result in a decrease in a pressure of at least a portion of the supersonic jet (e.g., a decrease from a first pressure greater than the atmospheric pressure to a second pressure equal to approximately one half of the atmospheric pressure). In other instances, the expansion of at least a portion of the supersonic jet can result in any suitable change in pressure (e.g., any suitable decrease in pressure).

The expansion can result in a barrel shock region 303 at the jet core that is isentropic and irrotational, as descried in detail above with reference to the launcher 10. In some instances, the projectile 106 can intercept the combustion products 301 within the barrel shock region 303. As such, a stagnation of the combustion products 301 in the barrel shock region 303 against the projectile 106 (identified in FIG. 7 by the region 304) can allow recovery of at least a portion of the initial pressure in the chamber 101 prior to the transitioning of the closure member 103. This pressure can be calculated and/or approximated using Equation (8) below:

$$\frac{P_{base}}{P_{chamber}} = \left(1 + \frac{2k}{k+1}(M_{rel}^2 - 1)\right)^{\frac{-1}{k-1}} * \left(\frac{(k+1)M_{rel}^2}{(k-1)M_{rel}^2 + 2}\right)^{\frac{k}{k-1}} \quad \text{Equation (8)}$$

Where $P_{base}$ the pressure exerted on a base of the projectile 106, base is $P_{chamber}$ is the pressure in the chamber 101 prior to the transitioning of the closure member 103, k is the ratio of specific heats of the combustion products 301, and $M_{rel}$ is the Mach number of the combustion products 301 in the barrel shock region 303 relative to the projectile 106.

The pressure exerted on the base of the projectile 106 (e.g., $P_{base}$) produces a force that accelerates the projectile 106 forwards and/or in the direction of the supersonic jet. More specifically, pressure associated with the stagnation of the supersonic jet against the base of the projectile 106 produces a drag force on the base of the projectile 106 that can be calculated and/or approximated using Equation (9) below:

$$F_D = \tfrac{1}{2}(\nu - \nu_p)^2 * \rho * C_d * A \quad \text{Equation (9)}$$

Where $F_D$ is a drag force, $\nu$ is a velocity of the flow (e.g., within a portion of the supersonic jet), $\nu_p$ is a velocity of the projectile 106, $\rho$ is a density of the projectile 106, $C_d$ is a drag coefficient associated with the projectile 106, and A is a surface area of the base of the projectile 106 against which the supersonic jet is stagnated.

Accordingly, the launcher 200 can exert a force on the base of the projectile 106 that accelerates the projectile 106 in a manner substantially similar to the manner described above with reference to the launchers 10 and/or 100.

Figure 8:
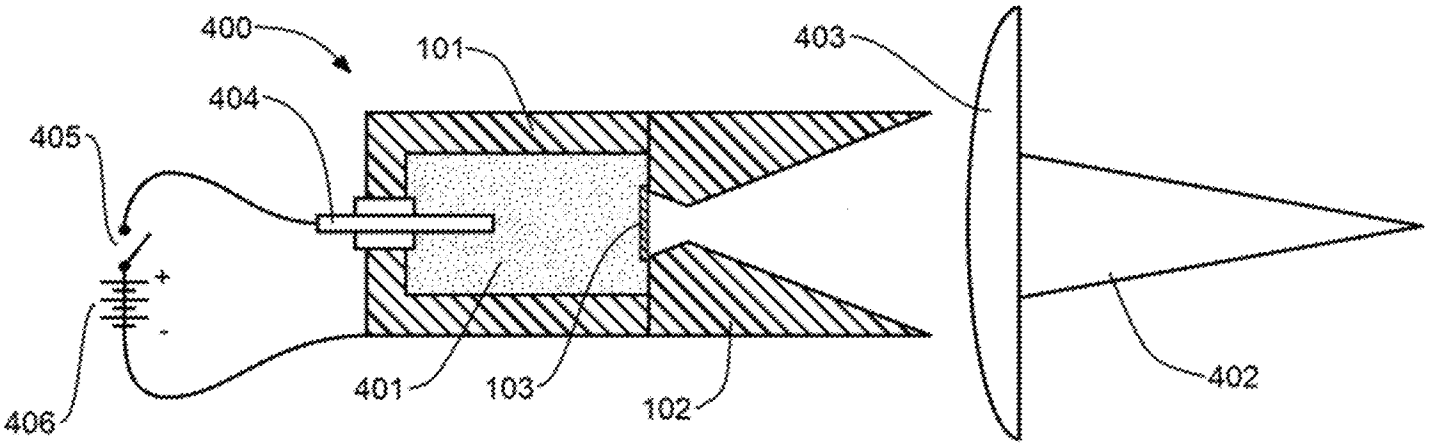
FIGS. 8-10 are cross-sectional views of a projectile launcher according to an embodiment, shown in a first state, a second state, and a third state, respectively.
Figure 9:
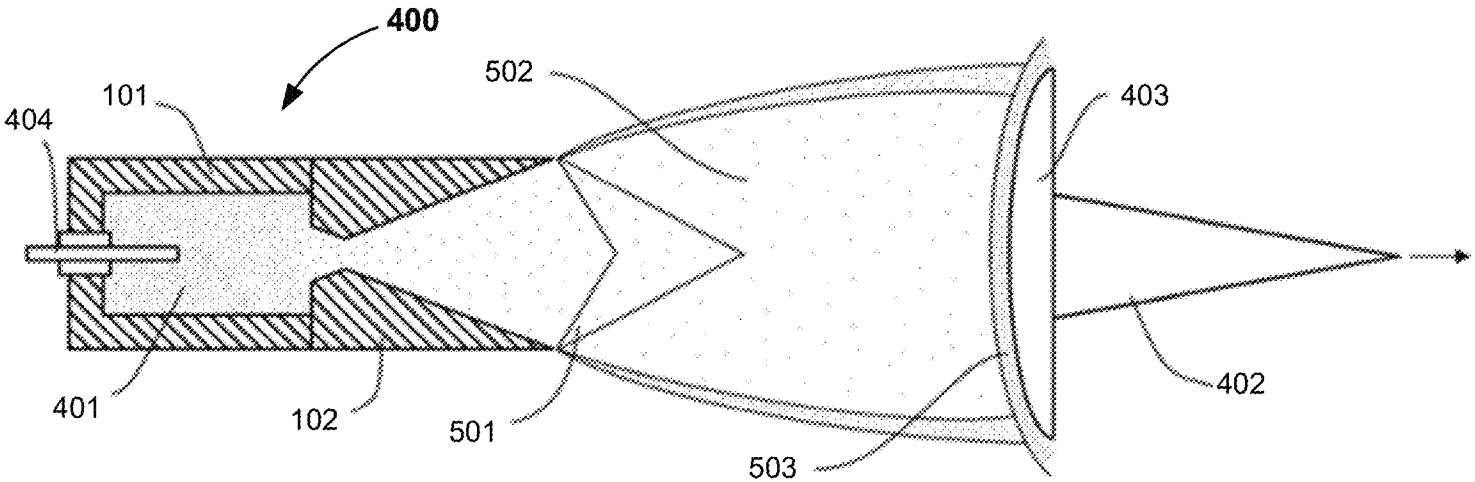
Figure 10:
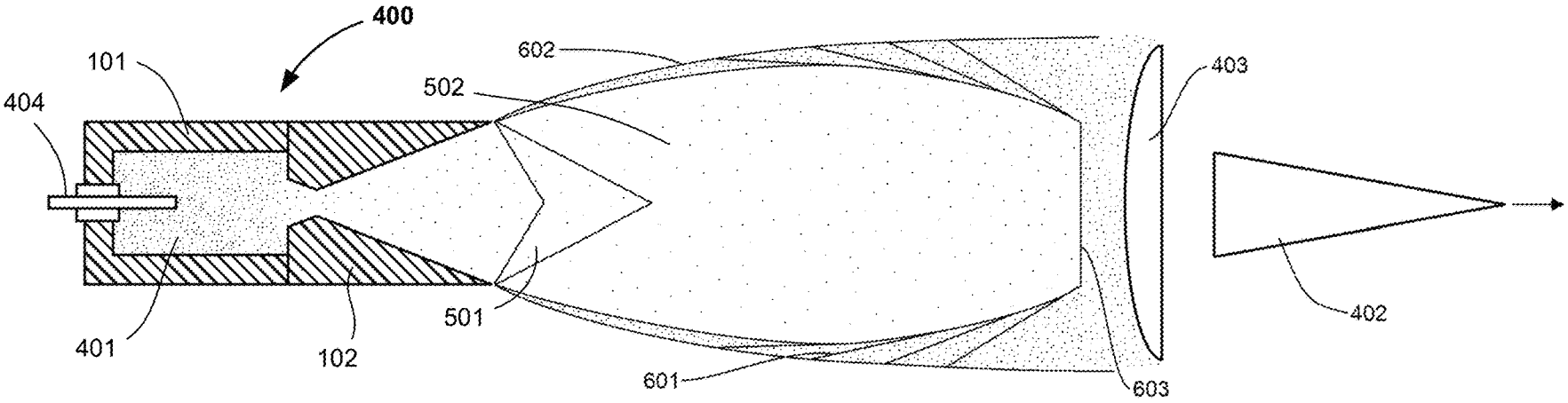

FIGS. 8-10 illustrate a projectile launcher 400 according to an embodiment. In some embodiments, the projectile launcher 400 (also referred to herein as "launcher") and/or portions thereof can be substantially similar to the projectile launchers 10, 100, and/or 200 described above. In the embodiment shown in FIGS. 8-10, the launcher 400 can be configured for use with an energy source configured to discharge an electrical arc to provide thermal and/or electrical energy to an amount of propellant contained in a portion of the launcher 400. As described above with reference to the launcher 100, the launcher 400 includes the chamber 101, the nozzle 102, and the closure member 103.

In the embodiment shown in FIGS. 8-10, however, the chamber 101 is filled with a non-combustible propellant 401. The non-combustible propellant 401 can be any suitable non-combustible propellant such as any of the propellants and/or gasses described herein. As shown in FIG. 8, a cathode 404 and/or any other suitable electrically conductive member can be operably coupled to the chamber 101 and configured to discharge an electrical arc to the non-combustible propellant 401 to transfer and/or convey thermal energy. In some embodiments, the cathode 404 and/or other electrically conductive member can be electrically coupled to an electrical circuit that can provide the cathode 404 with a voltage from a voltage source 406 in response to a switch 405 being closed, thereby completing the electrical circuit. In other embodiments, the launcher 400 can include any suitable mechanism, device, and/or circuit configured to discharge an electrical arc inside the chamber 101. In some embodiments, conveying thermoelectric energy to the non-combustible propellant 401 can provide increases in the temperature and/or pressure of the propellant that are greater than would otherwise result from combustion of a combustible propellant.

In use, the switch 405 can be closed such that the voltage source 406 provides a voltage to the cathode 404. In response, the cathode 404 can discharge an electrical arc in the chamber 101 that conveys thermal energy to the non-combustible propellant 401 disposed therein. As described in detail above with reference to the launcher 10, the increase in the temperature of the non-combustible propellant 401 can result in a corresponding increase in pressure and/or enthalpy that is sufficient to transition (e.g., rupture) the closure member 103 from the closed state to the open state.

As shown in FIG. 9, the pressurized and/or high-enthalpy non-combustible propellant 401 expands through the nozzle 102 after the transitioning (e.g., rupturing) of the closure member 103. The resulting jet of supersonic gas can remain above atmospheric pressure at the exit plane of the nozzle 102. Said another way, the resulting supersonic jet of the non-combustible propellant 401 can be underexpanded as the jet flows through the exit plane of the nozzle 102. As described in detail above with reference to the launcher 10 shown in FIG. 1, the underexpanded supersonic jet undergoes a Prandtl-Meyer expansion as a result of the exiting a boundary, surface, and/or plane of the nozzle 102 (shown in FIG. 9 as region 501). In some instances, the expansion of the supersonic jet can result in a decrease in a pressure of at least a portion of the supersonic jet (e.g., a decrease from a first pressure greater than the atmospheric pressure to a second pressure equal to approximately one half of the atmospheric pressure). In other instances, the expansion of at least a portion of the supersonic jet can result in any suitable change in pressure (e.g., any suitable decrease in pressure). Moreover, the expansion can result in a barrel shock region 502 at the jet core that is isentropic and irrotational, as descried in detail above with reference to the launcher 10.

As shown in FIGS. 8-10, the launcher 400 can be used to accelerate a projectile 402 that includes and/or that is coupled to a sabot 403. The projectile 402 can be similar to or substantially the same as any of the projectiles described herein (e.g., the projectiles 13 and/or 106). The sabot 403 can be any suitable shape, size, and/or configuration. For example, in some embodiments, the sabot 403 can have a relatively large surface area and a relatively low cross-sectional density. As shown in FIGS. 8-10, a surface of the sabot 403 that is normal to and/or in contact with the supersonic jet can have a surface area that is larger than a surface area of a surface of the projectile 402 that is normal to the supersonic jet and/or that would otherwise be in contact with the supersonic jet. In some embodiments, the arrangement of the projectile 402 and the sabot 403 can allow for a high terminal velocity of the projectile 402 by minimizing the cross-sectional density (e.g., of the sabot 403) and maximizing an amount of drag exerted on the sabot 403 by the supersonic flow.

Figure 11:
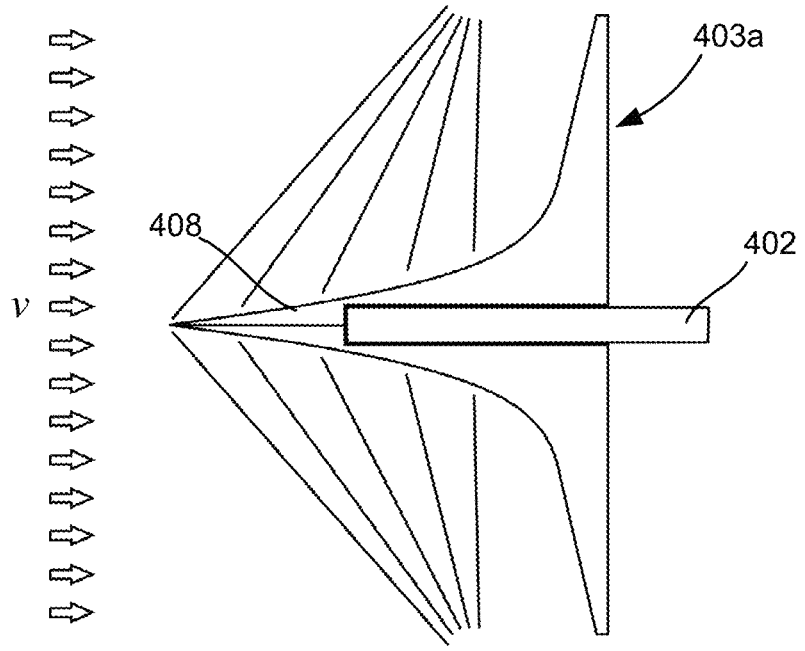
FIG. 11 is a schematic illustration of a sabot according to an embodiment and configured to facilitate the acceleration of a projectile.

While the sabot 403 is shown in FIGS. 8-10 as forming a disc or the like, in other embodiments, a sabot can have any suitable shape and/or configuration. For example, in some embodiments, a sabot (e.g., the sabot 403) can be configured such that a high amount of drag is exerted a first surface of the sabot that is in contact with the supersonic jet (e.g., a high amount of drag in the direction of the supersonic jet) and a relatively low amount of drag exerted on a second surface of the sabot that is not in contact with the supersonic jet and/or that is otherwise opposite the first surface (e.g., a relatively low amount of drag in a direction opposite the direction of the supersonic jet). In some embodiments, a sabot can have a size, shape, and/or arrangement configured to increase a stability of the sabot (and/or a projectile at least temporarily coupled the sabot such as the projectile 402) within the supersonic jet. For example, FIG. 11 illustrates a sabot 403*a* that is configured to be at least temporarily coupled to and/or in contact with the projectile 402. The sabot 403*a* shown in FIG. 11 can include an aerospike 408 and/or the like that can limit and/or otherwise reduce shock-induced losses to a pressure associated with the supersonic jet stagnating against a surface of the sabot 403*a* (e.g., a "stagnation pressure" exerted against the surface of the sabot 403*a* at least partially forming the aerospike 408). In other embodiments, a sabot 403 and/or at least a surface of the sabot can include one or more features such as fins, foils, ducts, ports, channels, and/or the like configured to increase stability of the sabot, impart a rotational motion on the sabot, selectively modify drag, shocks, and/or supersonic waves associated with accelerating the sabot and the projectile 402, and/or the like.

As described above with reference to the projectiles 13 and/or 106, in some instances, the sabot 403 and the projectile 402 can be positioned relative to the nozzle 102 such that the sabot 403 intercepts the non-combustible propellant 401 within the barrel shock region 502 of the supersonic jet. As such, a stagnation of the non-combustible propellant 401 in the barrel shock region 502 against the projectile 106 (identified in FIG. 9 by region 503) can allow recovery of at least a portion of the initial pressure in the chamber 101 prior to the transitioning of the closure member 103. This pressure can be calculated and/or approximated using Equation (3) provided above. Moreover, the force exerted by the stagnated supersonic jet on the surface of the sabot 403 can be calculated and/or approximated using Equation (4) provided above.

As shown in FIG. 10, the projectile 402 and the sabot 403 can be accelerated by the supersonic jet until compression waves 601 traveling from a jet boundary 602 (e.g., compression waves forming a convergence angle with an axial flow direction of the supersonic jet, as described above with reference to FIG. 2) intersect to form a termination shock wave 603 (e.g., a normal shock wave). In some instances, the flow of the non-combustible propellant 401 can be such that after the termination shock wave 603, the non-combustible propellant 401 is decelerated to a speed below that of the projectile 403. As such, a net pressure exerted on the sabot 403 can be directed in a direction opposite the direction of the supersonic jet. Thus, the net pressure exerted on the sabot 403 results in the separation of the sabot 403 from the projectile 402. Once separated, the projectile 402 is no longer accelerated by the supersonic jet and continues to coast. In some instances, the supersonic jet can accelerate the projectile 402 to a velocity equal to or greater than an escape velocity of the projectile 402, thereby allowing the projectile 402 to coast and/or otherwise travel beyond the gravitational attraction of the Earth.

Figure 12:
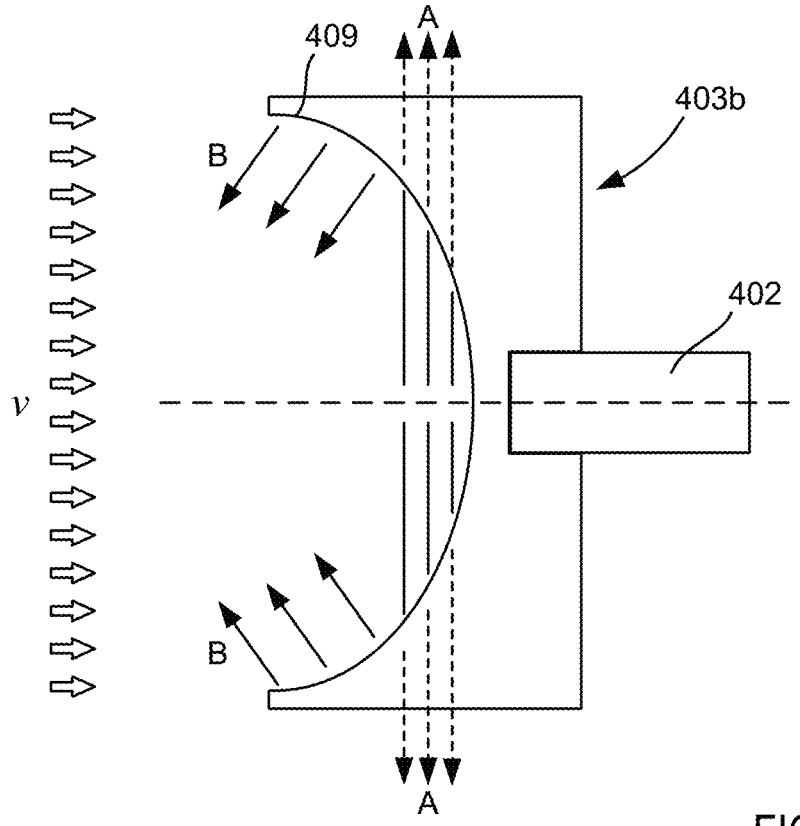
FIG. 12 is a schematic illustration of a sabot according to an embodiment and configured to facilitate redirection of a portion of a free jet used to accelerate a projectile.

While the projectile 402 is described as being accelerated with the sabot 403, it should be understood that the projectile 402 can be accelerated in a similar manner using any suitable sabot such as, for example, the sabot 403*a* described above with reference to FIG. 11. FIG. 12 illustrates a sabot 403*b* according to another embodiment. The sabot 403*b* can include, for example, a surface (e.g., a contact or base surface) that has a relatively concave shape (referred to herein as the "concave surface" 409). The sabot 403*b* can be coupled to the projectile 402 as described above with reference to the sabots 403 and 403*a*. In the embodiment shown in FIG. 12, the concave surface 409 of the sabot 403*b* can be configured to redirect at least a portion of the flow of the jet that stagnates against the surface 409. More particularly, in embodiments in which a contact or base surface of the sabot (or projectile) is flat or convex relative to an axial flow direction of the jet, at least a portion of the flow can be directed, wasted, and/or otherwise not recovered. For example, the portion of the flow can flow along or in the direction of the convex and/or flat contact or base surface of the sabot or projectile. In examples in which the surface is flat, the flow of the portion of the jet can be substantially orthogonal to the axial flow direction of the jet, as indicated in FIG. 12 by the arrows "A" shown in dashed lines. As such, this portion of the flow of the jet does not exert a thrust on the on the sabot or projectile.

The concave surface 409 of the sabot 403*b* shown in FIG. 12, however, can be configured to redirect the portion of the flow of the jet back into the core axial flow of the jet, as indicated by the arrows "B" shown in solid lines. In some implementations, the redirection of the portion of the flow of the jet can allow for recovery of at least a portion of the heat or temperature associated with the portion of the flow of the jet. As described above with reference to the launcher 10 and Equation (4), increasing a recovery temperature associated with the jet can result in a corresponding and/or proportional increase in thrust exerted by the jet on the concave surface 409. In other words, the concave surface 409 of the sabot 403*b* can be shaped, size, and/or otherwise configured to redirect at least a portion of the jet to increase and/or substantially maximize an amount of thrust associated with and/or resulting from the recovery temperature (e.g., the redirection of the portion of the flow).

While the concave surface 409 is particularly shown in FIG. 12 and described above, it should be understood that a sabot and/or a projectile can have a contact or base surface with any suitable shape, size, and/or configuration that is configured to redirect at least a portion of a flow of a jet to increase a recovery temperature associated therewith. In some embodiments, a sabot or projectile can have a concave shape similar to the concave surface 409 shown in FIG. 12. In other embodiments, a sabot can have a triangular-shaped surface, a rectangular-shaped surface (e.g., with flat or curved edges or side walls), an irregularly-shaped and/or complex surface, and/or the like that can redirect a portion of the flow to increase a recovery temperature associated therewith.

Figure 13:
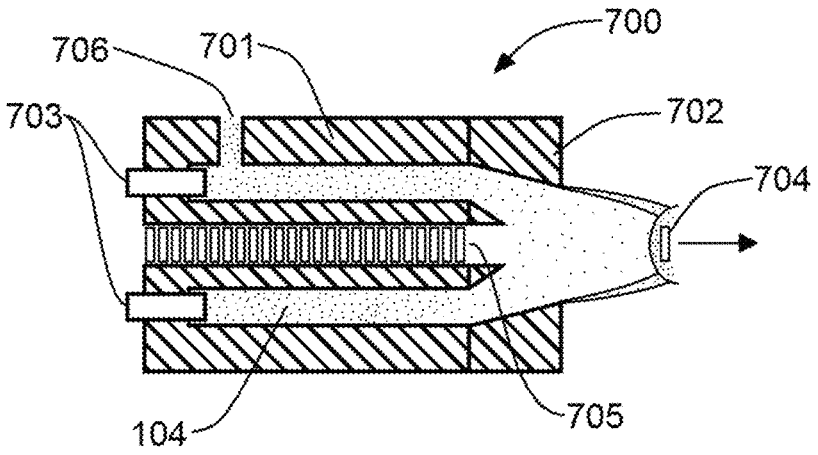
FIG. 13 is a cross-sectional view of a projectile launcher according to an embodiment.

FIG. 13 illustrates a projectile launcher 700 according to an embodiment. In some embodiments, the projectile launcher 700 (also referred to herein as "launcher") and/or portions thereof can be substantially similar in at least form and/or function to the projectile launchers 10, 100, 200, and/or 400 described above. In the embodiment shown in FIG. 13, the launcher 700 is configured for automatic use and/or at least semi-automatic use.

As shown, the launcher 700 includes a chamber 701 attached to an annular nozzle 702. In some embodiments, the chamber 701 and the nozzle 702 can be similar to or substantially the same as the chamber 101 and/or the nozzle 102 described in detail above. For example, as described above, the chamber 701 can receive and at least temporarily contain a propellant such as, for example, the propellant 104 described above with reference to the launcher 100. In the embodiment shown in FIG. 13, the launcher 700 includes an annular heating device 703 that is operably coupled to the chamber 701 and configured to transfer energy (e.g., thermal energy) to the propellant 104 disposed therein. In some embodiments, for example, the annular heating device 703 can be substantially similar in at least form and/or function to the heating device 105 described above with reference to the launcher 100.

The arrangement of the launcher 700 can be such that any suitable number of projectiles 704 are stacked in a magazine 705 (e.g., a tubular magazine and/or any other suitable magazine, storage device, delivery device, etc.). In some embodiments, the magazine 705 can be configured to automatically expel and/or otherwise place a projectile 704 into the flow of propellant 104 substantially outside of the nozzle 702 (e.g., beyond an exit plane of the nozzle 702, as described in detail above). In some embodiments, the launcher 700 can be configured such that a substantially continuous feed of the propellant 104 is provided to an inner volume of the chamber 701 via a fill port 706 and/or any other suitable filling mechanism. In some instances, a firing rate of launcher 700 can be dependent only on a time required for the projectile 704 to be accelerated by the supersonic jet exiting the nozzle 702, and can be estimated (e.g., at least for a cylindrical or disk-shaped projectile) by Equation (10) below:

$$rpm = \frac{60P_{base}}{\rho L v_{terminal}} \qquad \text{Equation (10)}$$

Where rpm is rounds per minute, $P_{base}$ is the pressure exerted on the base of the projectile 704, ρ is the density of the projectile 704, L is the length of the projectile 704, and $v_{terminal}$ is the terminal velocity of the projectile 704.

In this manner, the launcher 700 can be configured to generate a supersonic free jet of the propellant 104 that can be stagnated against the base of the projectile 704. The stagnation pressure of the supersonic free jet against the base of the projectile 704, in turn, results in a force on the base of the projectile 704 that accelerates the projectile 704 in a manner substantially similar to the manner described above with reference to the launchers 10, 100, 200, and/or 400 and thus, the launcher 700 is not described in further detail herein.

Figure 14:
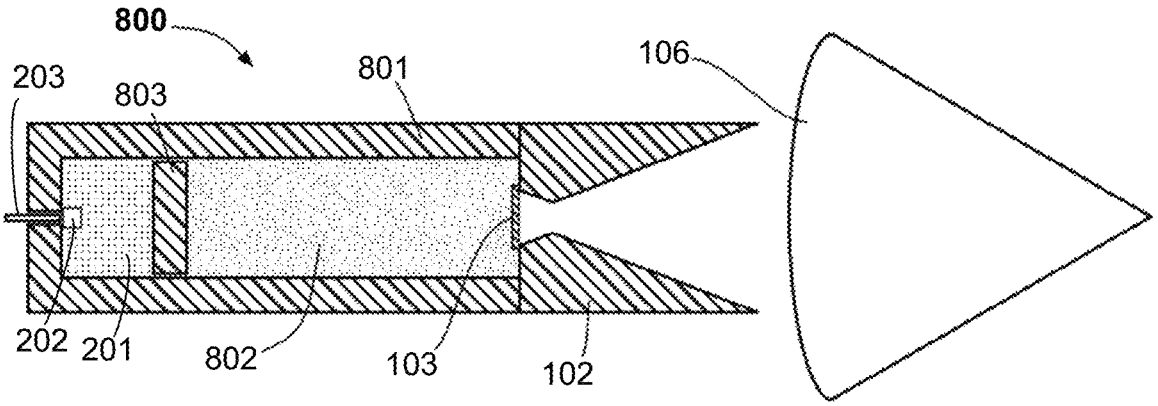
FIG. 14 is a cross-sectional view of a projectile launcher according to an embodiment.

FIG. 14 illustrates a projectile launcher 800 according to an embodiment. In some embodiments, the projectile launcher 800 (also referred to herein as "launcher") and/or portions thereof can be substantially similar to the projectile launchers 10, 100, 200, 400, and/or 700 described above. In the embodiment shown in FIG. 14, the launcher 800 can be configured to use rapid compression of a propellant to increase an amount of internal energy and/or enthalpy of the propellant. In some embodiments, the launcher 800 and/or portions thereof can be substantially similar in at least form and/or function to some two-stage light gas launchers (guns).

As described above with reference to, for example, the launcher 200, the launcher 800 shown in FIG. 14 includes the nozzle 102, the closure member 103, and is configured to accelerate the projectile 106. Moreover, the launcher 800 includes a chamber 801 in selective fluid communication with the nozzle 102 (e.g., via the closure member 103). The chamber 801 includes a piston 803 that separates an inner volume of the chamber 801. In a first volume or portion of the inner volume, the chamber 801 receives and at least temporarily contains the combustible solid propellant 201 (described in detail above with reference to the launcher 200). In a second volume or portion of the inner volume, the chamber 801 receives and at least temporarily contains a compressible propellant 802. In some instances, the compressible propellant 802 can be substantially similar to the propellant 104 and/or 401 described above. The piston 803 is movably disposed in the chamber 801 and fluidically isolates the first volume or portion of the chamber 801 from the second volume or portion of the chamber 802.

As described above with reference to the launcher 200, the launcher 800 shown in FIG. 14 includes the impact-sensitive primer 202 that can be operably coupled to the chamber 101 and used to initiate combustion of the combustible solid propellant 201 disposed in the first volume or portion of the chamber 801. In some embodiments, the impact-sensitive primer 202 can be initiated, activated, and/or otherwise primed by the firing pin 203 operably coupled thereto. In other embodiments, the launcher 800 can include any other suitable device, mechanism, and/or mode of initiating a combustion of the combustible solid propellant 201.

In use, the firing pin 203 can be engaged to trigger the primer 202. The primer 202, once triggered, can initiate combustion in and/or of the combustible solid propellant 201 which results in combustion products. The combustion products result in a pressure rise in the first volume or portion of the chamber 801 that is sufficient to rapidly move the piston 803 within the chamber 801 and in the direction of the nozzle 102. The movement of the piston 803 in the direction of the nozzle 102 compresses the compressible propellant 802 disposed in the second volume or portion of the chamber 801 (e.g., a volume defined between the piston 803 and the closure member 103), thereby increasing a temperature and pressure of the compressible propellant 802. As such, a pressure of the compressible propellant 802 can be increased to an extent sufficient to transition (e.g., rupture) the closure member 103 from the closed state to the open state, allowing the compressible propellant 802 (e.g., having a high pressure and/or high enthalpy) to expand through the nozzle 102, as described in detail above with reference to the expansion structure 12.

As described in detail above, the resulting supersonic jet of the compressible propellant 802 can be used to accelerate the projectile 106. For example, the projectile 106 can intercept the compressible propellant 802 within a barrel shock region of the supersonic jet (not shown n FIG. 14). As such, a stagnation of the compressible propellant 802 against the projectile 106 can allow recovery of at least a portion of the initial pressure of the compressible propellant 802 in the chamber 801 prior to the transitioning of the closure member 103. Accordingly, the launcher 800 can exert a force on the base of the projectile 106 that accelerates the projectile 106 in a manner substantially similar to the manner described above with reference to the launchers 10, 100, 200, 400, and/or 700.

Figure 15:
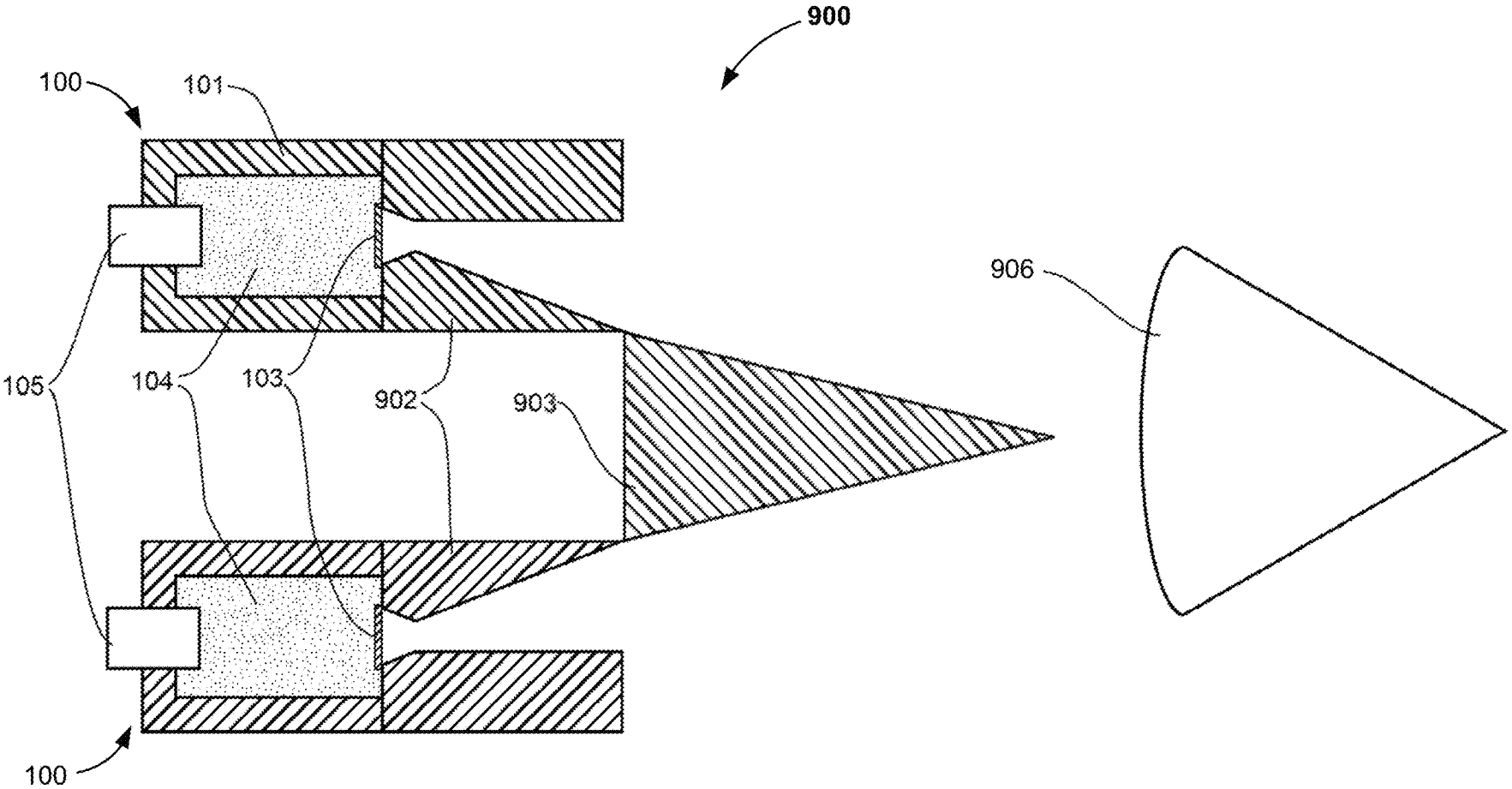
FIG. 15 is a cross-sectional view of an array of projectile launchers according to an embodiment.

FIG. 15 illustrates an array of projectile launchers 900 according to an embodiment. In some embodiments, the array of projectile launchers 900 (also referred to herein as "array of launchers" or simply "array") and/or portions thereof can be substantially similar to the projectile launchers 10, 100, 200, 400, 700, and/or 800 described above. In the embodiment shown in FIG. 15, the array of launchers 900 can include a number of launchers 100 (e.g., similar to or the same as the launcher 100 described above with reference to FIG. 5). In other embodiments, the array of launchers 900 can include a number of any of the launchers 100, 200, 400, 700, and/or 800 described herein. Moreover, the array of launchers 900 can be an array of the same launcher (e.g., an array of the launchers 100) or an array including any suitable combination of launchers such as those described herein.

As described above with reference to the launcher 100 shown in FIG. 5, each launcher 100 included in the array 900 includes a chamber 101, a closure member 103, propellant 104, and heating device 105. Moreover, each launcher 100 included in the array is connected to a nozzle 902. In some embodiments, each nozzle 902 can be substantially similar to any of the expansion structures and/or nozzles described herein (e.g., the expansion structure 12, the nozzle 102, and/or the nozzle 702. Accordingly, each nozzle 902 can be configured to allow a pressurized gas (e.g., the propellant 104) to expand, thereby resulting in a supersonic jet of the gas, as described in detail above.

In the embodiment shown in FIG. 15, each nozzle 902 is configured to merge a supersonic jet produced by the associated launcher 100 into a single and/or combined supersonic jet that can be used to accelerate a projectile 906. In some embodiments, an aerospike structure 903 can be used to accomplish the merging of the supersonic jets produced by the launchers 100 and exiting the nozzles 902. In some embodiments, the merging of the supersonic jets produced by the launchers 100 and exiting the nozzles 902 can result in a supersonic jet that has a larger dimension(s) (e.g., a larger merged diameter) than can be practically produced by a single launcher. For example, in some instances, large launchers (e.g., including a chamber with a large volume) can be cost prohibitive, thereby placing a restriction of the size of the launcher and/or a limit on the size of a projectile that can be accelerated by the launcher. As such, the array of launchers 900 can be configured to produce a supersonic jet having a set of characteristic suitable to launcher a projectile having any suitable size. In some instances, the use of the array of launchers 900 can be substantially similar to the use of any of the launchers 10, 100, 200, 400, 700, and/or 800 described above and thus, is not described in further detail herein.

Figure 16A:
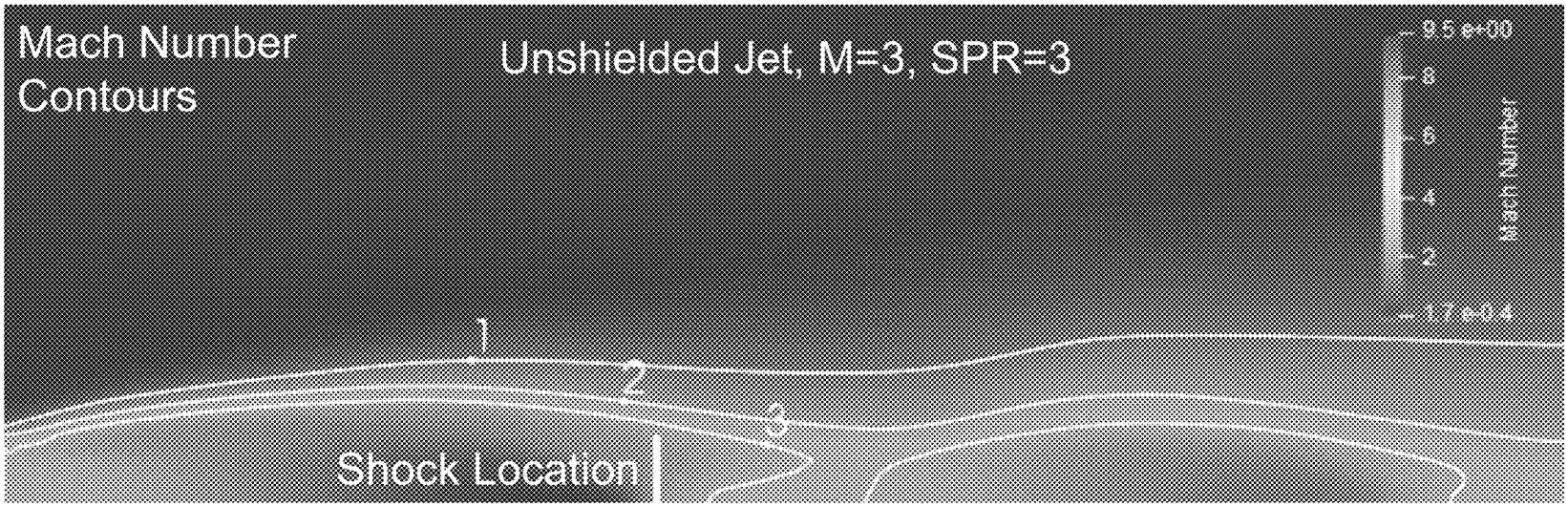
FIG. 16A is a graph illustrating flow contours of a free jet having a relatively low Mach number and being unshielded, according to an embodiment.
Figure 16B:
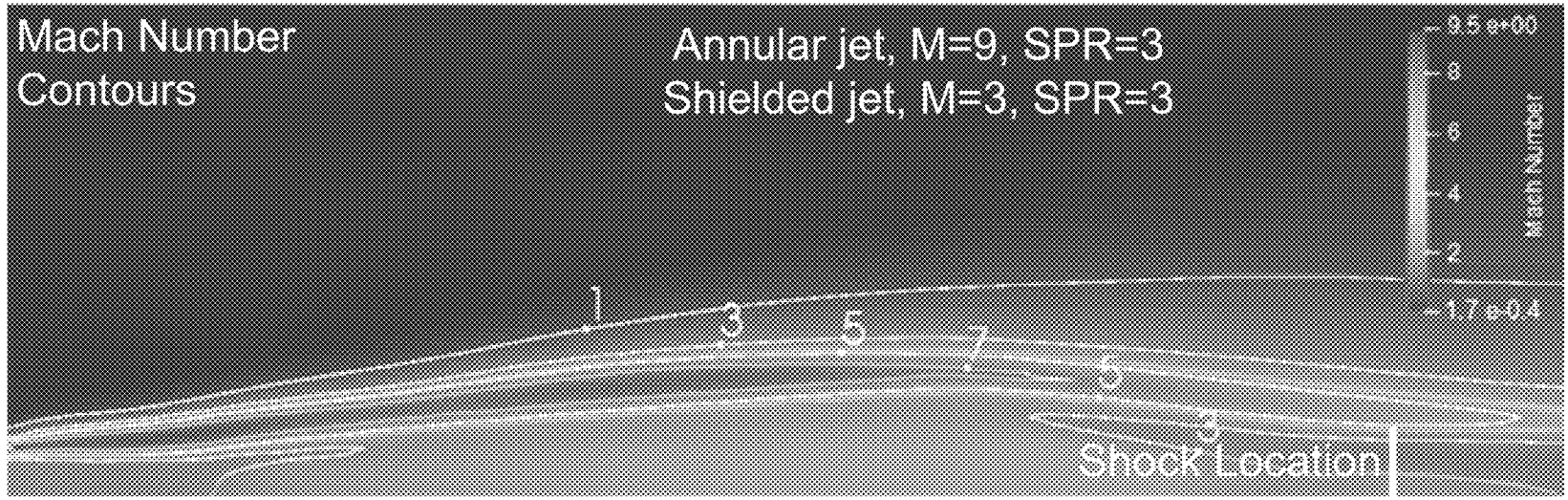
FIG. 16B is a graph illustrating flow contours of a free jet having the same relatively low Mach number as the free jet shown in FIG. 16A while being shielded by an annular free jet having a relatively high Mach number, according to an embodiment.

As described above with reference to FIGS. 1-4, in some implementations, it may be desirable to produce a free jet having an elongated barrel shock region. For example, any of the launchers 10, 100, 200, 400, 700, 800, and/or 900 can be configured to produce an annular free jet having a high Mach number that surrounds or shields (e.g., circumferentially surrounds or shields) the flow of a free jet having a lower Mach number. In such embodiments, the annular free jet and the free jet surrounded by the annular free jet can have the same or substantially parallel axial flow directions. In some instances, surrounding or shielding the inner free jet (e.g., having the lower Mach number) with the annular free jet can be operative in elongating the barrel shock region of the inner, low-Mach number jet. For example, FIG. 16A is a graph illustrating the flow contours of a single, unshielded free jet having a Mach number equal to 3 and a static pressure ratio (SPR) equal to 3, where the static pressure ratio is the static pressure of the unshielded free jet as the jet exits the nozzle divided by the atmospheric pressure around the exit of the nozzle. FIG. 16B is a graph illustrating the flow contours of a free jet having a Mach number equal to 3 and an SPR equal to 3 that is shielded by an annular free jet having a Mach number equal to 9 and an SPR equal to 3. In some instances, the annular free jet (FIG. 16B) can circumferentially surround (e.g., in an axial or circumferential direction relative to the axial flow direction, which in turn, can limit and/or reduce interactions between the free jet having the lower Mach number and the atmosphere (e.g., interactions resulting in the expansion and recompression of the lower Mach number free jet). As shown, the shock location associated with the shielded jet (FIG. 16B) extends beyond the shock location otherwise resulting from the unshielded jet (FIG. 16A). In other words, the shielded free jet has an elongated barrel shock region relative to the barrel shock region of the unshielded free jet.

In some embodiments, a launcher (e.g., the launchers 10, 100, 200, 400, 700, 800, and/or 900) can be configured to produce a jet having a high Mach number via, for example, two-phase flow. More particularly, in some instances, incompressible particles can be included in and/or introduced into a compressible gas, which in turn, will change the effective molecular weight of the gas. In some implementations, the launcher can be configured to separate the two-phase flow or portion of the gas from, for example, a substantially single-phase flow or portion of the gas via, for example, centrifugal forces. As such, a portion of the gas carrying the incompressible particles (e.g., a denser portion of the gas and/or a two-phase portion of the gas) will flow outward in response to the centrifugal forces, thereby forming the two-phase annular jet. Moreover, because the gas flowing within the annular jet is more dense than the gas flowing in the shielded jet (e.g., the shielded jet is a single-phase jet in that the jet does not carry the incompressible particles or carries a substantially smaller amount of the incompressible particles relative to the two-phase annular jet), the Mach number of the two-phase annular jet can be greater than the Mach number of the single-phase shielded jet despite the annular jet flowing with a velocity lower than a velocity of the shielded jet (e.g., resulting from the incompressible particles increasing drag forces associated with the two-phase annular jet).

While a launcher is described above as being configured to use centrifugal forces to separate a heavy, dense, and/or two-phase gas (e.g., forming the annular jet) from a light, low-density, and/or single-phase gas (e.g., forming the shielded or core jet), in other embodiments, a launcher can be configured to produce the two-phase jets via any suitable manner. For example, in some embodiments, a launcher can include a first chamber that contains a first propellant configured to be expanded to form the supersonic free jet having the relatively low Mach number (e.g., around Mach 3) and can include a second chamber that contains a second propellant different from the first propellant that is configured to expand to form the annular free jet (e.g., a hypersonic free jet) having the relatively high Mach number (e.g., between about Mach 6 and about Mach 10). In such embodiments, the second propellant can produce a flow of pressurized gas that has a density greater than a density of the pressurized gas produced by the first propellant. In addition, the launcher can include any suitable expansion structure and/or the like capable of directing, separating, and/or otherwise producing the two-phase flow. In other embodiments, the two-phase flow can be produced by, for example, two separate launchers used in conjunction. In some embodiments, the launcher producing the lower-Mach number jet can be embedded and/or positioned within a portion of the launcher producing the higher-Mach number jet.

Figure 17:
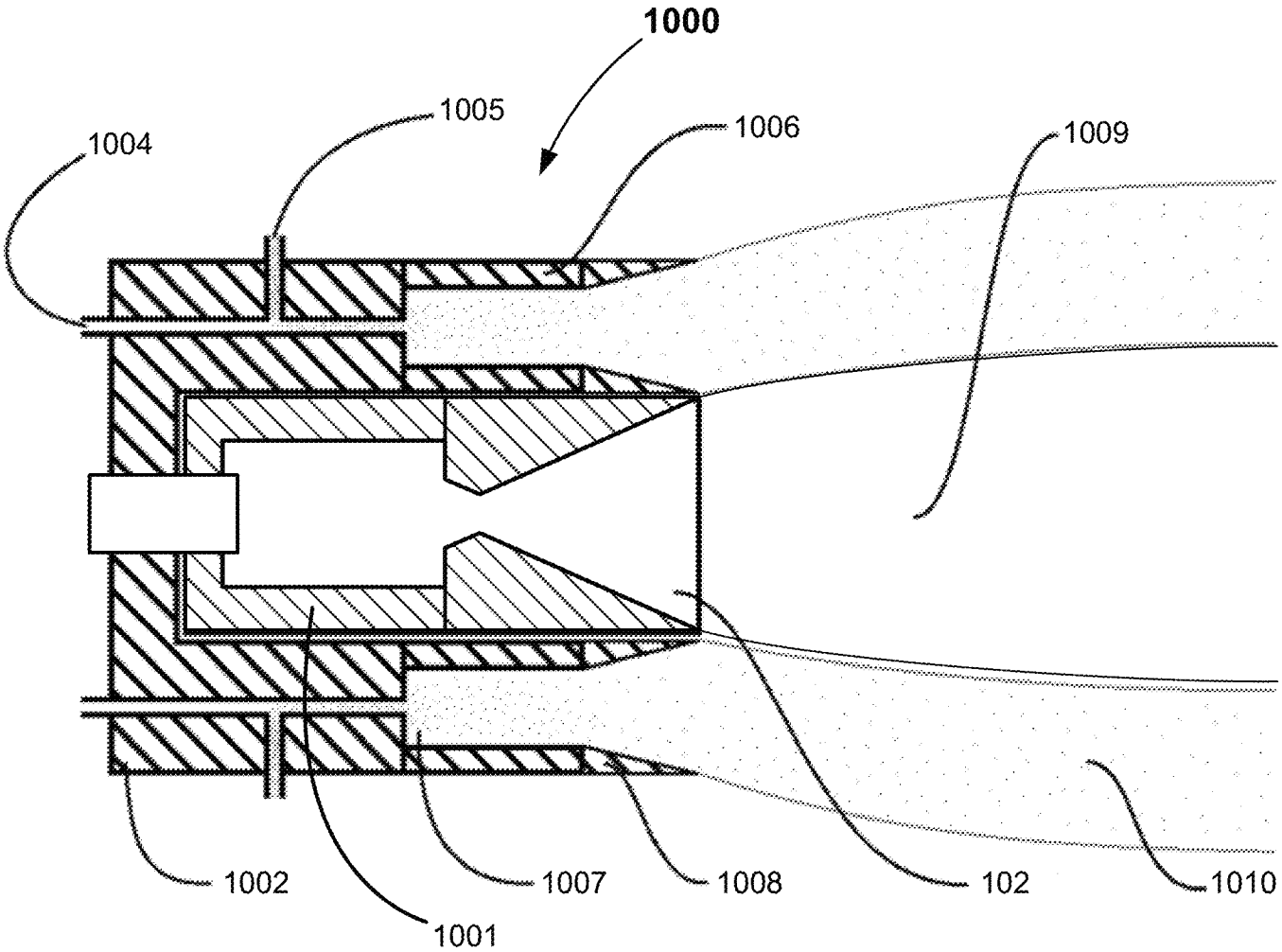
FIG. 17 is a cross-sectional view of a projectile launcher according to an embodiment.

For example, FIG. 17 is a schematic illustration of a projectile launcher 1000 according to an embodiment. In some embodiments, the projectile launcher 1000 (also referred to herein as "launcher") and/or portions thereof can be substantially similar to the projectile launchers 10, 100, 200, 400, 700, 800, and/or 900 described above (or corresponding portions thereof). In the embodiment shown in FIG. 17, the launcher 1000 can be configured to produce one or more free jets included, for example a "two-phase jet." In some embodiments, the launcher 1000 can be configured to produce two or more free jets (and/or a flow of gas having two or more distinct portions), each of which having one or more distinct, unique, and/or different characteristic(s).

As described above with reference to, for example, the launcher 200, the launcher 1000 includes the nozzle 102 that is configured to accelerate a projectile (not shown in FIG. 17). Moreover, the launcher 1000 includes a first chamber 1001 and a second chamber 1002. The first chamber 1001 is in selective fluid communication with at least a portion of the nozzle 102 (e.g., via a closure member such as the closure member 103). In some embodiments, the second chamber 1002 can be in fluid communication with at least a portion of the nozzle 102 (e.g., via the closure member 103 and/or a different closure member such as any of those described herein). In other embodiments, the second chamber can be in fluid communication with a separate nozzle and/or expansion structure. For example, the second chamber 1002 can be an annular chamber disposed and/or secured around the first chamber 1001 and/or a portion of the nozzle 102.

In some embodiments, the first chamber 1001 can contain a first propellant that is configured to be expanded through at least a portion of the nozzle 102 to form an underexpanded supersonic free jet 1008 having a relatively low Mach number (e.g., around Mach 3), as described in detail above with reference to the launchers 10, 100, 200, 400, 700, 800, and/or 900. In some embodiments, the second chamber 1002 can contain a second propellant that is configured to be expanded through at least a portion of the nozzle 102 and/or a separate nozzle or expansion structure to form an annular free jet 1009 (e.g., a hypersonic free jet) having the relatively high Mach number (e.g., between about Mach 6 and about Mach 10). The first propellant and the second propellant can be the same propellant or different propellants. For example, in some embodiments, the first propellant can be any of the propellants described above with reference to the launchers 10, 100, 200, 400, 700, 800, and/or 900, and configured to produce the underexpanded free jet 1009. In some embodiments, the second propellant can be different from the first propellant and can be configured to produce the two-phase annular jet 1010 including, for example, a flow of compressible gas (e.g., particles having a first phase) that carries incompressible particles (e.g., particles having a second phase).

For example, in some implementations, the annular jet 1010 can be produced by and/or can result from a flow of a pressurized liquid 1004 entraining incompressible particles 1005 which are in a solid or liquid phase (at atmospheric pressure and temperature). The pressurized liquid 1004 can be any suitable liquid that is gaseous at atmospheric pressure (e.g., heated water, carbon dioxide, methane, propane, and/or the like). In some instances, the pressurized liquid 1004 can be released and accelerated—as a result of a decrease in pressure from its initial pressurized condition to or toward an ambient pressure—thereby accelerating the incompressible particles 1005 that are entrained in the flow pressurized liquid 1004. In some implementations, the accelerated liquid 1004 can be flash-evaporated in an annular evaporation chamber 1006 and/or the like to produce, for example, a two-phase mixture 1007 including vaporized particles of the liquid 1004 and the incompressible particles 1005. The two-phase mixture 1007 has a relatively low sound speed (e.g., as a result of the incompressible particles 1005). Moreover, the two-phase mixture 1007 has a relatively high Mach number based at least in part on the relatively low sound speed and a relatively high velocity resulting from the pressurized liquid 1004 being accelerated prior to the evaporation of the liquid 1004 in the evaporation chamber 1006. As shown in FIG. 17, the two-phase mixture 1007 is further expanded and accelerated through a portion of the nozzle 1002 and/or a second, annular nozzle 1008, thereby producing the two-phase annular jet 1010 having the relatively high Mach number (e.g., a free jet having a Mach number in a hypersonic range between about Mach 6 to about Mach 10).

As described above, the two-phase annular jet 1010 can flow substantially around a circumference of the underexpanded supersonic free jet 1009 produced by accelerating the first propellant through the nozzle 102 (or a portion thereof). In some instances, the two-phase annular jet 1010 can surround the supersonic free jet 1009 to shield the supersonic free jet 1009 from at least some interactions with the atmosphere. As shown in FIGS. 16A and 16B, the shielding of the supersonic free jet 1009 can result in an elongation of a barrel shock region of the supersonic free jet 1009, which in turn, can increase an acceleration path associated with the supersonic free jet 1009 accelerating the projectile (not shown in FIG. 17).

Example 1

In this example, a projectile launcher (also referred to herein as "launcher") was built and included a chamber (e.g., similar to the chamber 101), and a nozzle (e.g., similar to the nozzle 102). The chamber had an inner diameter that was approximately 12.5 millimeters (mm) and an inner volume of about 5,700 $mm^3$. The nozzle was machined from a ⅝-inch bolt and included a 3.0 mm throat and 9.0 mm exit diameter, for an expansion ratio of 3. The chamber was filled with 1 gram (g) of double-base propellant, which released approximately 5.0 kilojoules (kJ) of combustion energy at a stagnation pressure of approximately 100 megapascals (MPa) and a temperature of approximately 3,000 Kelvin (K). In this example, cardboard was used as a closure member (e.g., similar to the closure member 103).

The launcher was used to accelerate two projectiles. A first projectile had a mass equal to 27.4 g and a second projectile had a mass equal to 12.7 g. In this example, the first projectile achieved a greater ballistic efficiency than the second projectile because the first projectile intercepted a larger portion of the supersonic jet and therefore, removed more kinetic energy from the flow. With the propellant stagnation properties held constant, characteristics associated with accelerating the first projectile and the second projectile were compared and terminal velocities ("Term. Vel.") were calculated using two assumptions: (1) terminal velocity was reached instantaneously ("Min. Vel.") and (2) fixed acceleration throughout the barrel shock region ("Min. Accel."). The results are shown in Table 1 below:

TABLE 1

Transit Times and Inferred Velocities

| Test | Transit Distance (mm) | Transit Time (μs) | Terminal Vel. (m/s) Min. Vel. | Terminal Vel. (m/s) Min. Accel. | Vel. (m/s) considering ballistic eff. |
|---|---|---|---|---|---|
| First Projectile (1) | 80 | 1360 +/− 80 | 55.00 | 125.00 | 63.80-125.00 |
| First Projectile (2) | 80 | 1200 +/− 80 | 62.50 | 143.00 | 63.80-143.00 |
| Second Projectile (1) | 60 | 560 +/− 80 | 93.75 | 250.00 | 93.75-210.00 |
| Second Projectile (2) | 60 | 560 +/− 80 | 93.75 | 250.00 | 93.75-210.00 |

Figure 18:
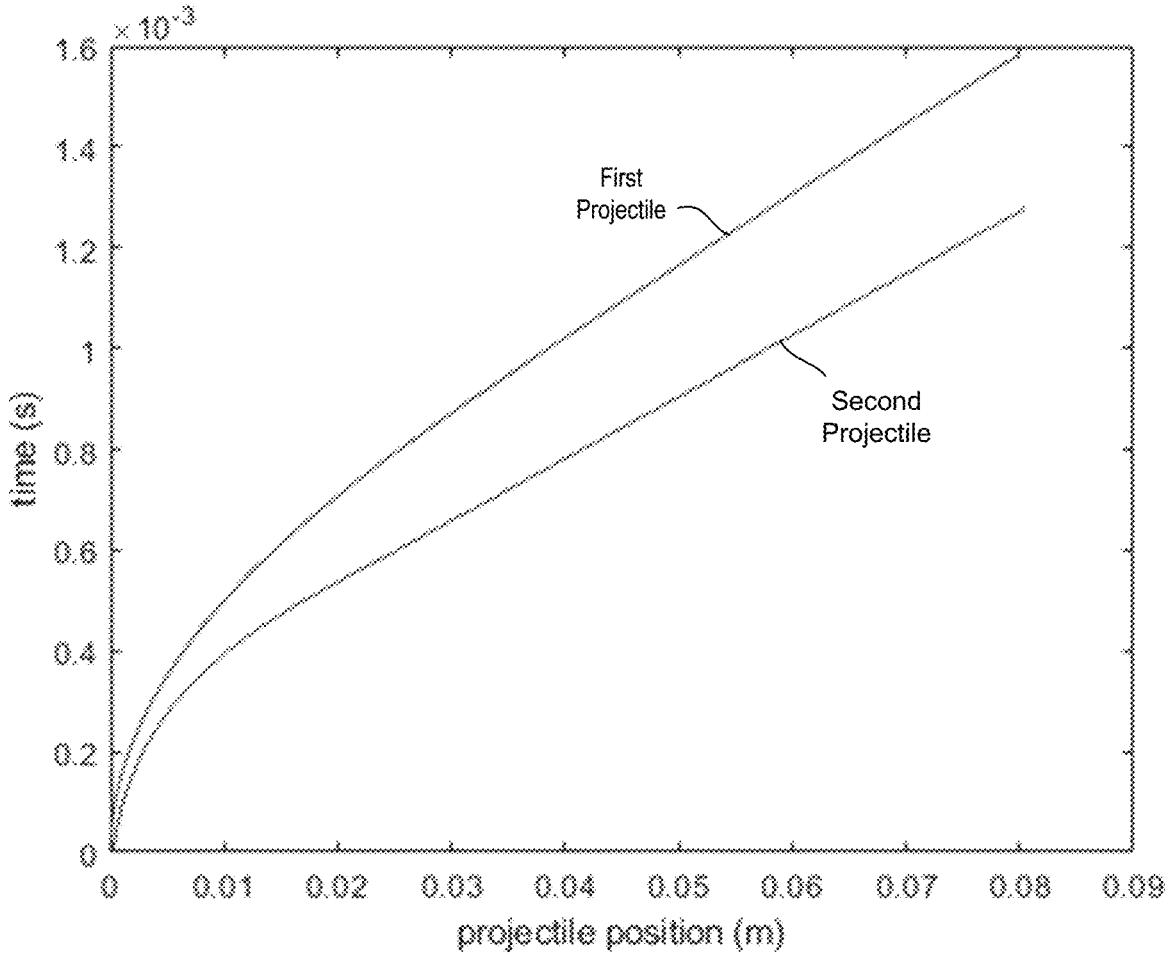
FIG. 18 is a graph illustrating a relationship between a transit distance and a transit time for a first projectile and a second projectile.

FIG. 18 is a graph illustrating a calculated relationship between a transit distance and a transit time for the first projectile and the second projectile. In this example, the ballistic efficiency of the launcher was determined to be between about 1.1% and about 5.6%.

Example 2

In this example, a projectile launcher (also referred to herein as "launcher") was built and included a chamber (e.g., similar to the chamber 101), and a nozzle (e.g., similar to the nozzle 102). The chamber had an inner diameter that was approximately 12.5 mm and an inner volume of about 5,700 $mm^3$. The nozzle was machined from a ⅝-inch bolt and included a 3.0 mm throat. The chamber was filled with 1.9 g of double-base propellant, which released approximately 9.0 kJ of combustion energy at a stagnation pressure of approximately 100 MPa and a temperature of approximately 3,000 K. In this example, cardboard was used as a closure member (e.g., similar to the closure member 103).

The launcher was used to accelerate a projectile having a mass equal to 13.5 g. In this example, the nozzle produced an underexpanded supersonic free jet having a Mach number of 4 at the nozzle exit and a pressure within the barrel shock region of about 5 MPa. The projectile intercepted the underexpanded supersonic free jet within the barrel shock region and was accelerated to a velocity of about 450.0 meters per second (m/s). The launcher achieved a ballistic efficiency of about 15%.

Example 3

In this example, a projectile launcher (also referred to herein as "launcher") was built and included a chamber (e.g., similar to the chamber 101), and a nozzle (e.g., similar to the nozzle 102). The chamber had an inner diameter that was approximately 90.0 mm and an inner volume of about $1\times10^6$ $mm^3$. The nozzle had a throat diameter of 32.0 mm and an exit diameter of 45.0 mm for an expansion ratio of 1.4.

In this example, the launcher used electrically-assisted chemical combustion to produce high pressure and/or high enthalpy gas. Specifically, the chamber was filled with 50 g of double-base propellant disposed around a consumable bridge wire. A closure member (e.g., a diaphragm) was positioned to temporarily isolate the chamber from the throat of the nozzle. A capacitor was used to rapidly discharge 800 joules (J) of energy at 1,100 Volts (V), which was sufficient to vaporize the bridge wire. The rapid ignition of the propellant resulted in a combustion that released approximately 240.0 kJ of combustion energy at a stagnation pressure of approximately 30 MPa and a temperature of approximately 3,000 K.

The launcher was used to accelerate a projectile having a mass equal to 120 g. In this example, the nozzle produced an underexpanded supersonic free jet having a Mach number of 2.2 at the nozzle exit and a pressure within the barrel shock region of about 50 kPa. The projectile intercepted the underexpanded supersonic free jet within the barrel shock region and was accelerated to a velocity of about 253.0 m/s. The launcher achieved a ballistic efficiency of about 1.6%.

Example 4

In this example, a projectile launcher (also referred to herein as "launcher") was built and included a chamber (e.g., similar to the chamber 101), an electrothermal energy source (e.g., similar to the cathode 404) and a nozzle (e.g., similar to the nozzle 102). The chamber had an inner diameter that was approximately 12.5 mm and an inner volume of about 5,700 $mm^3$. The nozzle was machined from a ⅝-inch bolt and included a 3.0 mm throat. The chamber was filled with 1 g of water, which was heated by the discharge of energy from a capacitor bank with an initial voltage of 5,000 V, a capacitance of 540 microfarads, and an energy storage capacity of 6,250 J. In this example, cardboard was used as a closure member (e.g., similar to the closure member 103). In some instances, the projectile launcher described in this example can function in a substantially manner to any of the projectile launchers described in the embodiments and/or examples described above.

Example 5

In this example, a projectile launcher (also referred to herein as "launcher") was built and included a chamber (e.g., similar to the chamber 101 and a nozzle (e.g., similar to the nozzle 102). The chamber had an inner diameter that was approximately 170 mm and an inner volume of about 13 Liters or about $1.3\times10^7$ $mm^3$. The nozzle was machined from a cylinder of cement with a diameter of 240 mm and included a 100 mm diameter throat.

In this example, the launcher used electrically-assisted chemical combustion to produce high pressure and/or high enthalpy gas. Specifically, the chamber was filled with 2400 g of a stoichiometric mixture of kerosene and air pressurized to 15 MPa, which was ignited by the discharge of energy from a capacitor bank with an initial voltage of 1,000 V, a capacitance of 2,000 microfarads, and an energy storage capacity of 1,000 J. In this example, a stainless steel plate with a thickness of ⅜-inch was used as a closure member. In some instances, the projectile launcher described in this example can function in a substantially manner to any of the projectile launchers described in the embodiments and/or examples described above.

Figure 19:
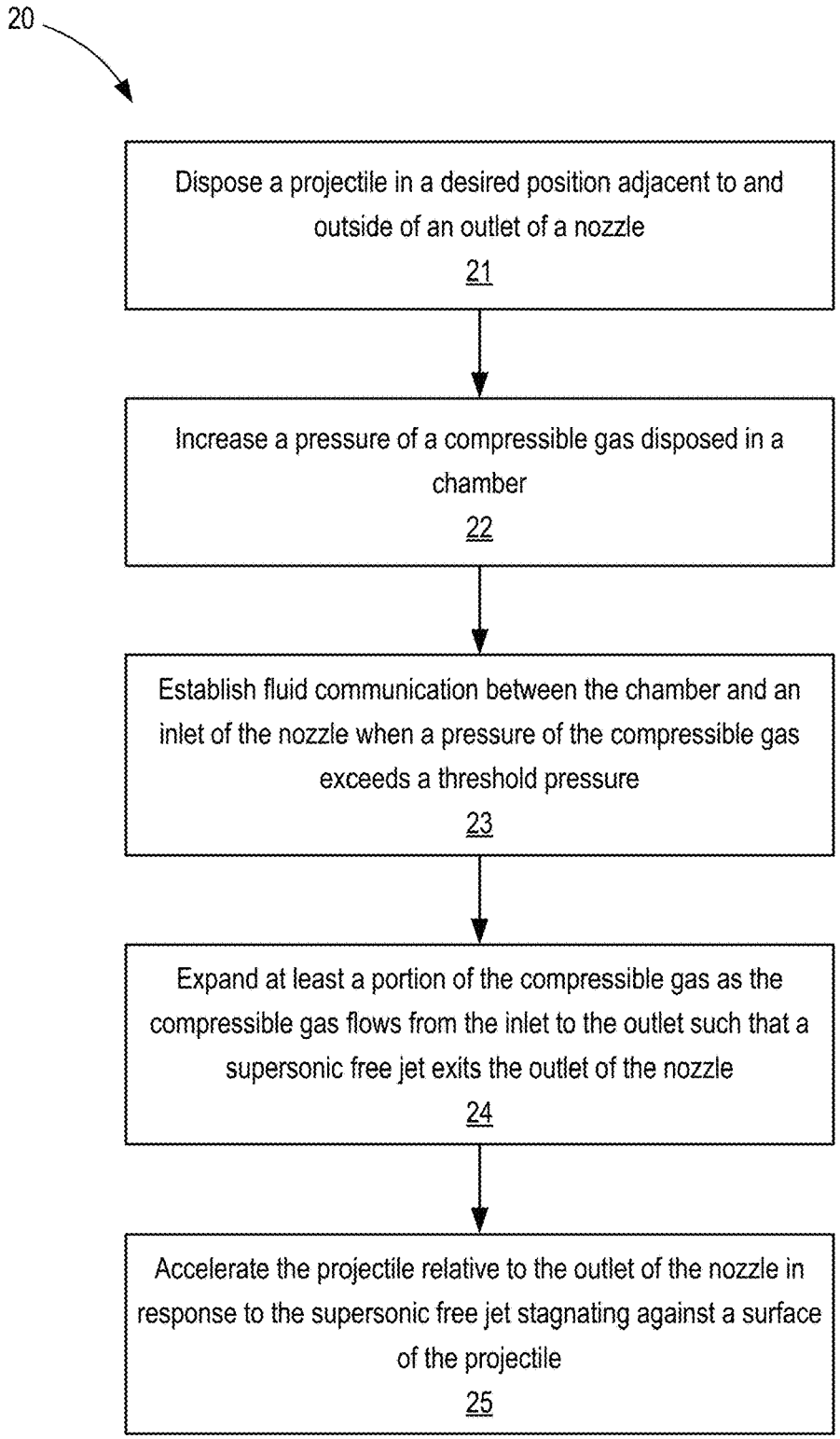
FIG. 19 is a flowchart illustrating a method of accelerating an object according to an embodiment.

FIG. 19 is a flowchart illustrating a method 20 of accelerating a projectile using an external free jet according to an embodiment. In some embodiments, the method 20 can include accelerating a projectile using any of the projectile launchers described herein (e.g., the projectile launchers 10, 100, 200, 400, 700, 800, 900, 1000, and/or any of the projectile launchers described in Examples 1-5). As such, the projectile launcher can be configured to produce, for example, an underexpanded supersonic free jet that is stagnated against a surface of the projectile to accelerate the projectile to a desired velocity.

The method 20 includes disposing the projectile in a desired position adjacent to and outside of an outlet of a nozzle, at 21. The projectile can be any suitable projectile such as any of those described herein. In some embodiments, the projectile can be a munition and/or the like. In other embodiments, the projectile can be a payload intended to be launched to a given altitude relative to the Earth's surface (e.g., launched into at least low Earth orbit).

The nozzle of the launcher can be any suitable nozzle and/or expansion structure. For example, in some embodiments, the nozzle can be a divergent nozzle in which an inlet or throat of the nozzle has a first diameter and an outlet of the nozzle has a second diameter larger than the first diameter. In some embodiments, the outlet diameter of the nozzle is significantly larger than an inlet or throat diameter. In other embodiments, the nozzle can be, for example, a convergent-divergent nozzle. In still other embodiments, the nozzle can be any of the nozzles and/or expansion structures described in detail herein. As such, the nozzle can be configured to allow a flow of a high pressure and/or high enthalpy gas to expand as the gas flows from the inlet or the throat of the nozzle to the outlet of the nozzle, as described in further detail herein.

As described above with reference to the launchers 10, 100, 200, 400, 700, 800, 900, and/or 1000, the launcher used in the method 20 can include a chamber that is coupled to the nozzle. The chamber is configured to receive and at least temporarily contain a compressible gas. In some embodiments, the compressible gas can be a non-combustible propellant. In other embodiments, the chamber can receive a liquid or solid combustible propellant that can be ignited to generate combustion products (e.g., the compressible gas).

As shown in FIG. 19, a pressure of the compressible gas disposed in the chamber is increased, at 22. For example, the launcher can include an energy source that is operably coupled to the chamber and configured to discharge an amount of energy into the compressible gas. The energy can be any suitable form of energy such as any of those described herein. For example, in some embodiments, the energy source can provide thermal energy, electrothermal energy, chemical energy, electrical energy, ignition energy, kinetic energy, and/or the like. In some instances, the energy conveyed to the compressible gas (or the propellant configured to produce the compressible gas) can result in an increase in a temperature, pressure, internal energy, enthalpy, etc. of the compressible gas. For example, in some embodiments, the energy source can discharge an amount of energy into the compressible gas that results in a rapid increase in a pressure of the gas.

When a pressure of the compressible gas exceeds a threshold pressure, fluid communication is established between the chamber and the inlet or throat of the nozzle, at 23. For example, the launcher can include a closure member or the like configured to at least temporarily isolate an inner volume of the chamber from the inlet of the nozzle. In some embodiments, the closure member can be a pressure-dependent member configured to transition from a closed state to an open state in response to a sufficient pressure being exerted on at least a portion of the closure member. For example, the closure member can be a frangible seal, membrane, diaphragm, film, and/or the like configured to rupture when a pressure of the compressible gas exceeds the threshold pressure. In other embodiments the closure member can be a pressure-dependent valve and/or the like. In some embodiments, the arrangement of the closure member can allow for a desired amount of pressure increase of the compressible gas prior to allowing the pressurized gas to flow into and/or through the nozzle.

With a pressure of the compressible gas exceeding the threshold pressure (e.g., the pressure is sufficient to transition the closure member from the closed state to the open state), at least a portion of the compressible gas is expanded as the compressible gas flows from the inlet to the outlet of the nozzle such that a supersonic free jet exits the outlet of the nozzle, at 24. More specifically, in some embodiments, the arrangement of the nozzle can be such that the supersonic free jet is underexpanded, as described in detail above with reference to specific embodiments. In some embodiments, the underexpanded supersonic free jet of the compressible gas can form a shock structure that forms a barrel shock region in which the flow of the compressible gas can be considered inviscid and irrotational. In some instances, it may be desirable to position the projectile such that the projectile intercepts the flow of the compressible gas within the barrel shock region, as described in detail above.

The projectile is accelerated relative to the outlet of the nozzle in response to the supersonic free jet stagnating against a surface of the projectile, at 25. For example, the stagnation of a portion of the supersonic free jet results in a stagnation pressure being applied against the surface (e.g., a base) of the projectile. As described in detail above with reference to at least the launchers 10, 100, and 200, the stagnation pressure on the surface of the projectile, in turn, results in a force (e.g., a drag force) that accelerates the projectile relative to the outlet of the nozzle. Moreover, in some instances, the supersonic free jet can be configured to accelerate the projectile while the projectile is within the barrel shock region of the supersonic free jet. After the projectile is placed beyond the barrel shock region (e.g., beyond a termination or normal shock wave), the supersonic free jet no longer accelerates the projectile.

Figure 20:
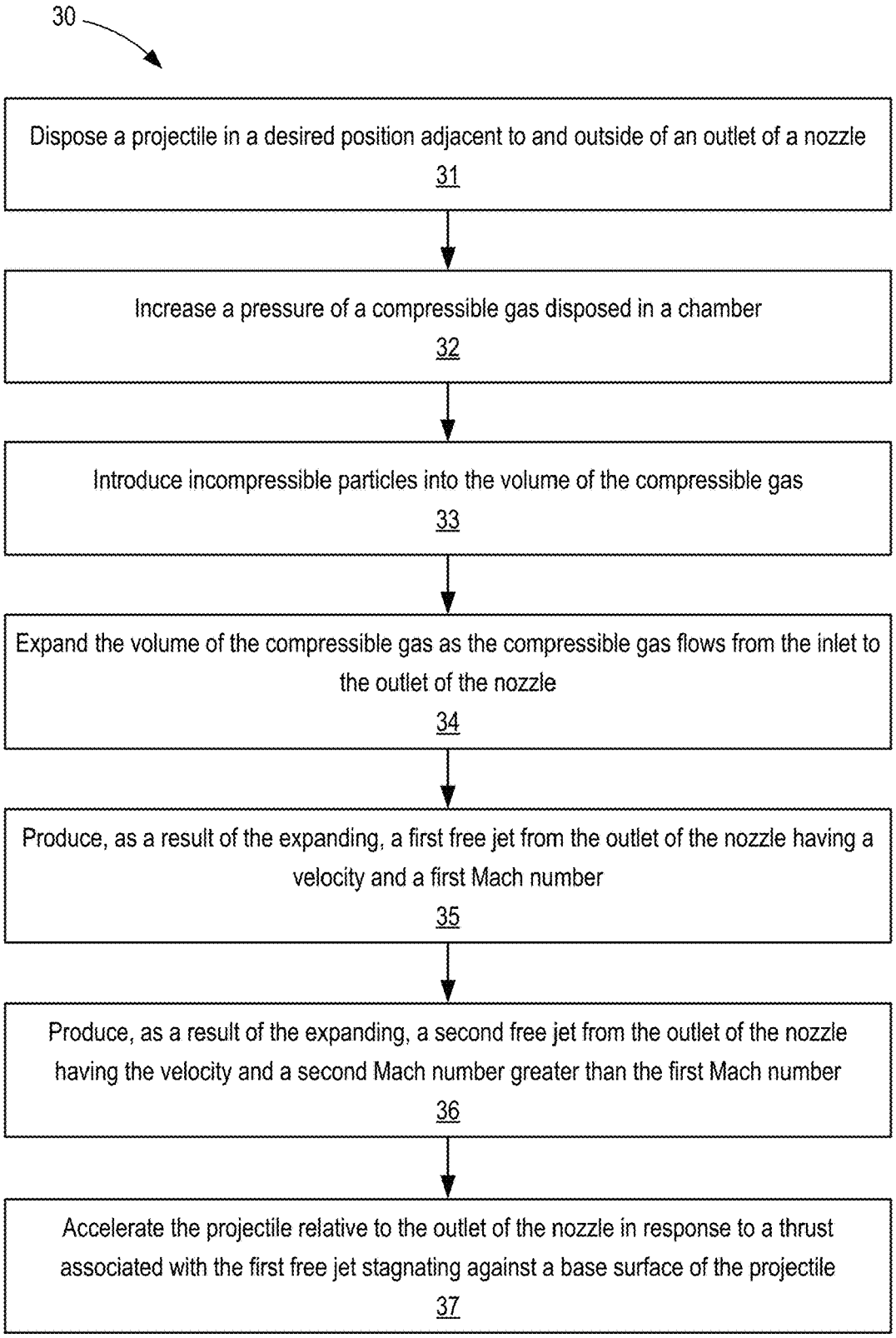
FIG. 20 is a flowchart illustrating a method of accelerating an object according to an embodiment.

FIG. 20 is a flowchart illustrating a method 30 of accelerating a projectile according to an embodiment. In some embodiments, the method 30 can include accelerating a projectile using any of the projectile launchers described herein (e.g., the projectile launchers 10, 100, 200, 400, 700, 800, 900, 1000, and/or any of the projectile launchers described in Examples 1-5). As such, the projectile launcher can be configured to produce, for example, a free jet that is stagnated against a base surface of the projectile to accelerate the projectile to a desired velocity.

The method 30 includes disposing the projectile in a desired position adjacent to and outside of an outlet of a nozzle, at 31. The projectile can be any suitable projectile such as any of those described herein. For example, in some embodiments, the projectile can be substantially similar to any of the projectiles 13, 106, 402, 704, 906, and/or 1006. In some embodiments, the projectile can be a munition and/or the like. In other embodiments, the projectile can be a payload intended to be launched to a given altitude relative to the Earth's surface (e.g., launched into at least low Earth orbit).

The nozzle of the launcher can be any suitable nozzle and/or expansion structure. For example, in some embodiments, the nozzle can be a divergent nozzle in which an inlet or throat of the nozzle has a first diameter and an outlet of the nozzle has a second diameter larger than the first diameter. In some embodiments, the outlet diameter of the nozzle is significantly larger than an inlet or throat diameter. In other embodiments, the nozzle can be, for example, a convergent-divergent nozzle. In still other embodiments, the nozzle can be any of the nozzles and/or expansion structures described in detail herein. As such, the nozzle can be configured to allow a flow of a high pressure and/or high enthalpy gas to expand as the gas flows from the inlet or the throat of the nozzle to the outlet of the nozzle, as described in further detail herein.

As described above with reference to the launchers 10, 100, 200, 400, 700, 800, 900, and/or 1000, the launcher used in the method 30 can include a chamber that is coupled to the inlet of the nozzle. The chamber is configured to receive and at least temporarily contain a compressible gas. In some embodiments, the compressible gas can be a non-combustible propellant. In other embodiments, the chamber can receive a liquid or solid combustible propellant that can be ignited to generate combustion products (e.g., the compressible gas). In some embodiments, a propellant can include and/or can be configured to form a compressible gas and incompressible particles (e.g., as combustion products and/or the like).

As shown in FIG. 20, a pressure of the compressible gas disposed in the chamber is increased, at 32. For example, the launcher can include an energy source that is operably coupled to the chamber and configured to discharge an amount of energy into the compressible gas. The energy can be any suitable form of energy such as any of those described herein. For example, in some embodiments, the energy source can provide thermal energy, electrothermal energy, chemical energy, electrical energy, ignition energy, kinetic energy, and/or the like. In some instances, the energy conveyed to the compressible gas (or the propellant configured to produce the compressible gas) can result in an increase in a temperature, pressure, internal energy, enthalpy, etc. of the compressible gas. For example, in some embodiments, the energy source can discharge an amount of energy into the compressible gas that results in a rapid increase in a pressure of the gas. Moreover, in some embodiments, when a pressure of the compressible gas exceeds a threshold pressure, the chamber can be placed in fluid communication the inlet or throat of the nozzle. For example, the launcher can include a closure member or the like configured to at least temporarily isolate an inner volume of the chamber from the inlet of the nozzle until a pressure exceeds the threshold pressure, as described above with reference to the launchers 10, 100, 200, 300, 400, 700, 800, 900, and/or 1000.

Incompressible particles are introduced into the volume of the compressible gas, at 33. In some instances, the incompressible particles can be particles of one or more metal oxides and/or the like. As described above, in some implementations, combusting a propellant can generate a compressible gas and incompressible particles. In other embodiments, the incompressible particles need not be a combustion product and instead can be introduced and/or injected into the chamber of the launcher, the volume of the compressible gas, and/or any other portion of the launcher.

The volume of the compressible gas is expanded as the compressible gas flows from the inlet to the outlet of the nozzle, at 34. More specifically, in some embodiments, the arrangement of the nozzle can be divergent nozzle, a convergent-divergent nozzle, and/or any other suitable nozzle configured to generate one or more external free jets (e.g., supersonic and/or hypersonic free jets), as described in detail above with reference to specific embodiments. For example, in this implementation, a first free jet having a velocity and a first Mach number is produced as a result of the expanding, at 35, and a second free jet having the velocity and a second Mach number greater than the first Mach number is produced as a result of the expanding, at 36.

In some instances, the first Mach number can be in a range of supersonic Mach numbers such as, for example, a Mach number that is greater than Mach 1 and less than Mach 5. In some instances, the second Mach number can be in a range of hypersonic Mach numbers such as, for example, a Mach number that is greater than Mach 5. In some instances, the second Mach number can be between about Mach 5 and about Mach 10. As an example, in some implementations, the first free jet can have a Mach number of about Mach 3 and the second free jet can have a Mach number of about Mach 9. Moreover, the velocity of the first free jet can be substantially similar to the velocity of the second free jet. As described in detail above, a Mach number of a gas moving at a constant velocity can be increased in response to an increase in an effective molecular weight of the gas. In other words, a Mach number of a gas moving at a constant velocity can be increased in response to an increase in a density of the gas. Accordingly, in some instances, the second free jet can have a density that is greater than a density of the first free jet (e.g., as a result of carrying and/or including substantially all or at least a greater portion of the incompressible particles).

The second free jet can be produced as an annular free jet configured to circumferentially surround the first free jet. For example, the first free jet and the second free jet can each flow in or with a common axial flow direction and the second free jet can surround the circumference of the first free jet (e.g., at a radial distance from an axis associated with the axial flow direction. As described in detail above, in some instances, a free jet can form a shock structure that forms a barrel shock region in response to interactions with the atmosphere (e.g., an expansion and recompression of the gas forming the free jet). In some instances, flow of the compressible gas can be considered inviscid and irrotational within the barrel shock region and thus, it can be desirable to increase a length of the barrel shock region of the first free jet. Accordingly, the second free jet (e.g., the annular free jet) can be configured to surround the first free jet to shield and/or limit interactions of the first free jet with the atmosphere, which in turn, can elongate the barrel shock region of the first free jet, as described in detail above.

The projectile is accelerated relative to the outlet of the nozzle in response to a thrust associated with the first free stagnating against a base surface of the projectile, at 37. For example, the stagnation of a portion of the first free jet results in a stagnation pressure being applied against the base surface of the projectile. As described in detail above with reference to at least the launchers 10, 100, and 200, the stagnation pressure on the base surface of the projectile, in turn, results in a force (e.g., a drag force) that accelerates the projectile relative to the outlet of the nozzle. Moreover, in some instances, the first free jet can be configured to accelerate the projectile while the projectile is within the elongated barrel shock region of the first free jet. In some instances, the method can also include redirecting a portion of the first free jet after stagnating against the base surface of the projectile. For example, in some embodiments, the base surface of the projectile can be a concave surface configured to redirect a portion of the first free jet toward the remaining portion of the first free jet flowing in the axial flow direction. In some such embodiments, the redirecting of the portion of the first free jet can increase a recovery temperature which in turn, can increase an amount of thrust associated with the recovery temperature of the first free jet.

The methods and systems described herein provide a means of continuously accelerating a projectile which possesses a structure an order of magnitude shorter than an equivalent gun-type launcher. The acceleration apparatus (e.g., launchers) absorb little waste heat during the acceleration process, enabling high sustained firing rates without mechanical complexity. Some embodiments described herein accelerate projectiles without limitations on the dimensions of the projectile. In some embodiment, the ballistic efficiency of the launchers described herein can be unaffected by the length of the acceleration path (e.g., a length of a barrel shock region of a supersonic free jet), enabling high cyclic firing rates. In some embodiments, a magnitude of the acceleration imparted to a projectile can be manipulated during launch by throttling the nozzle (e.g., increasing or decreasing an expansion ratio of the nozzle).

While various embodiments have been described above, it should be understood that they have been presented by way of example only, and not limitation. Where schematics and/or embodiments described above indicate certain components arranged in certain orientations or positions, the arrangement of components may be modified. While the embodiments have been particularly shown and described, it will be understood that various changes in form and details may be made without departing from the spirit and/or scope of the embodiments described herein. Although various embodiments have been described as having particular features and/or combinations of components, other embodiments are possible having a combination of any features and/or components from any of embodiments described herein.

The specific configurations of the various components can also be varied. For example, the size and specific shape of the various components can be different from the embodiments shown, while still providing the functions as described herein. More specifically, the size and shape of the various components can be specifically selected for a desired or intended usage. Thus, it should be understood that the size, shape, and/or arrangement of the embodiments and/or components thereof can be adapted for a given use unless the context explicitly states otherwise.

Where methods and/or events described above indicate certain events and/or procedures occurring in certain order, the ordering of certain events and/or procedures may be modified. Additionally, certain events and/or procedures may be performed concurrently in a parallel process when possible, as well as performed sequentially as described above.

What is claimed is:

1. An apparatus, comprising:

an energy source, the energy source configured to convey an amount of energy to a volume of a compressible gas disposed in a chamber and operable to increase a pressure associated with the volume of the compressible gas; and an expansion structure configured to be placed in fluid communication with the chamber to receive a flow of the compressible gas in response to the increase in pressure, the expansion structure including an inlet having a first diameter and an outlet having a second diameter greater than the first diameter, the expansion structure allowing the compressible gas to expand as the compressible gas flows from the inlet to the outlet such that a supersonic free jet of the compressible gas exits the outlet, the supersonic free jet of the compressible gas configured to accelerate a projectile disposed outside of the expansion structure.

2. The apparatus of claim 1, wherein the supersonic free jet is an underexpanded supersonic free jet.

3. The apparatus of claim 1, wherein the expansion structure is substantially stationary when the supersonic free jet exits the outlet, the supersonic free jet configured to accelerate the projectile relative to the expansion structure.

4. The apparatus of claim 1, wherein the energy source is a thermal energy source configured to convey thermal energy to the volume of the compressible gas disposed in the chamber, the thermal energy conveyed to the volume of the compressible gas operable to increase the pressure of the volume of the compressible gas disposed in the chamber.

5. The apparatus of claim 1, wherein the compressible gas includes a propellant, the energy source is an ignition source configured to initiate a combustion of the propellant, and the combustion of the propellant is operable to increase the pressure associated of the volume of the compressible gas.

6. The apparatus of claim 1, wherein the chamber includes a closure member configured to transition from a first state to a second state in response to the pressure associated with the compressible gas exceeding a threshold pressure between 0.2 megapascals (MPa) and 600.0 MPa, the closure member fluidically isolates the chamber from the inlet of the expansion structure when in the first state and allows fluid communication between the chamber and the inlet of the expansion structure when in the second state.

7. The apparatus of claim 1, wherein the energy source is a kinetic energy source, the kinetic energy source configured to compress the volume of the compressible gas.

8. The apparatus of claim 7, wherein the kinetic energy source is a piston.

* * * * *